US006779462B2

(12) United States Patent
Lloyd

(10) Patent No.: US 6,779,462 B2
(45) Date of Patent: Aug. 24, 2004

(54) KINETIC ENERGY ROD WARHEAD WITH OPTIMAL PENETRATORS

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/162,498

(22) Filed: Jun. 4, 2002

(65) Prior Publication Data

US 2003/0029347 A1 Feb. 13, 2003

Related U.S. Application Data

(60) Provisional application No. 60/295,731, filed on Jun. 4, 2001, now abandoned.

(51) Int. Cl.[7] ..... F42B 12/30

(52) U.S. Cl. ..... 102/475; 102/496; 102/501

(58) Field of Search ..... 102/501, 475, 102/476, 494, 495, 496, 497

(56) References Cited

U.S. PATENT DOCUMENTS

| | | | | | |
|---|---|---|---|---|---|
| 1,244,046 | A | | 10/1917 | Ffrench | |
| 1,300,333 | A | | 4/1919 | Berry | |
| 2,988,994 | A | * | 6/1961 | Fleischer, Jr. et al. | 102/490 |

(List continued on next page.)

FOREIGN PATENT DOCUMENTS

| | | | | | |
|---|---|---|---|---|---|
| DE | 38 30 527 | A1 | * | 3/1990 | 102/501 |
| EP | 270 401 | A1 | * | 6/1988 | 102/501 |
| FR | 2 678 723 | | * | 1/1993 | |
| GB | 550001 | | * | 12/1942 | 102/494 |
| WO | PCT/US96/19940 | | * | 7/1997 | 102/501 |

OTHER PUBLICATIONS

Richard M. Lloyd, "Physics of Direct Hit and Near Miss WarheadTechnology", vol. 194, Progress in Astronautics and Aeronautics, Copyright 2001 by the American Institute of Aeronautics and Astronautics, Inc., Chapter 3, pp. 99–197.

Richard M. Lloyd, "Physics of Direct Hit and Hear Miss Warhead Technology", vol. 194, Progress in Astronautics and Aeronautics, Copyright 2001 by the American Institute of Aeronautics and Astronautics, Inc., Chapter 6, pp. 311–406.

U.S. patent application Ser. No. 10/456,391, Lloyd et al., filed Jun. 5, 2003.

U.S. patent application Ser. No. 10/301,302, Lloyd filed Nov. 21, 2002.

U.S. patent application Ser. No. 10/301,420, Lloyd filed Nov. 21, 2002.

U.S. patent application Ser. No. 10/456,777, Lloyd filed Jun. 6, 2003.

U.S. patent application Ser. No. 10/385,319, Lloyd filed Mar. 10, 2003.

U.S. patent application Ser. No. 10/370,892, Lloyd filed Feb. 20, 2003.

U.S. patent application Ser. No. 10/698,500, Lloyd filed Oct. 31, 2003.

(List continued on next page.)

*Primary Examiner*—Stephen M. Johnson
(74) *Attorney, Agent, or Firm*—Iandiorio & Teska

(57) ABSTRACT

A kinetic energy rod warhead includes a projectile core in a hull including a plurality of individual uniquely shaped and densely packaged projectiles and an explosive charge in the hull about the core. The individual projectiles are preferably aligned when the explosive charge deploys the projectiles. The projectiles may also be aimed in a specific direction.

67 Claims, 27 Drawing Sheets

U.S. PATENT DOCUMENTS

| | | | | | |
|---|---|---|---|---|---|
| 3,565,009 | A | | 2/1971 | Allred et al. | |
| 3,656,433 | A | | 4/1972 | Thrailkill et al. | |
| 3,757,694 | A | * | 9/1973 | Talley et al. | 102/490 |
| 3,771,455 | A | | 11/1973 | Haas | |
| 3,797,359 | A | | 3/1974 | Mawhinney et al. | 89/1.8 |
| 3,877,376 | A | | 4/1975 | Kupelian | |
| 3,941,059 | A | | 3/1976 | Cobb | |
| 3,949,674 | A | * | 4/1976 | Talley | 102/490 |
| 3,954,060 | A | | 5/1976 | Haag et al. | |
| 3,977,330 | A | | 8/1976 | Held | |
| 4,026,213 | A | * | 5/1977 | Kempton | 102/490 |
| 4,036,140 | A | | 7/1977 | Korr et al. | |
| 4,089,267 | A | | 5/1978 | Mescall et al. | |
| 4,106,410 | A | * | 8/1978 | Borcher et al. | 102/490 |
| 4,210,082 | A | | 7/1980 | Brothers | |
| 4,211,169 | A | | 7/1980 | Brothers | |
| 4,376,901 | A | | 3/1983 | Pettibone et al. | |
| 4,430,941 | A | | 2/1984 | Raech, Jr. et al. | 102/496 |
| 4,638,737 | A | | 1/1987 | McIngvale | 102/489 |
| 4,655,139 | A | | 4/1987 | Wilhelm | 102/494 |
| 4,658,727 | A | | 4/1987 | Wilhelm et al. | 102/494 |
| 4,745,864 | A | | 5/1988 | Craddock | 102/491 |
| 4,770,101 | A | | 9/1988 | Robertson et al. | 102/489 |
| 4,848,239 | A | | 7/1989 | Wilhelm | 102/492 |
| 4,922,826 | A | | 5/1990 | Busch et al. | 102/489 |
| 4,996,923 | A | | 3/1991 | Theising | 102/438 |
| H1047 | H | | 5/1992 | Henderson et al. | 102/496 |
| H1048 | H | | 5/1992 | Wilson et al. | 102/496 |
| 5,229,542 | A | | 7/1993 | Bryan et al. | 102/491 |
| 5,370,053 | A | | 12/1994 | Williams et al. | 102/202.5 |
| 5,542,354 | A | | 8/1996 | Sigler | 102/478 |
| 5,544,589 | A | | 8/1996 | Held | 102/492 |
| 5,578,783 | A | * | 11/1996 | Brandeis | 102/490 |
| 5,670,735 | A | | 9/1997 | Ortmann et al. | 102/202 |
| 5,691,502 | A | | 11/1997 | Craddock et al. | 102/494 |
| 5,796,031 | A | | 8/1998 | Sigler | 102/520 |
| 5,823,469 | A | | 10/1998 | Arkhangelsky et al. | 244/3.22 |
| 6,044,765 | A | | 4/2000 | Regebro | 102/213 |
| 6,186,070 | B1 | | 2/2001 | Fong et al. | |
| 6,598,534 | B2 | | 7/2003 | Lloyd et al. | 102/494 |
| 6,622,632 | B1 | | 9/2003 | Spivak | 102/475 |

OTHER PUBLICATIONS

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193–251.

U.S. patent application Ser. No. 10/685,242, Lloyd filed Oct. 14, 2003.

U.S. patent application Ser. No. 10/384,804, Lloyd filed Mar. 10, 2003.

Richard M. Lloyd, "Aligned Rod Lethality Enhanced Concept for Kill Vehicles", 10th AIAA/BMDD Technology Conf., Jul. 23–26, Williamsburg, Virginia, 2001, pp. 1–12.

* cited by examiner

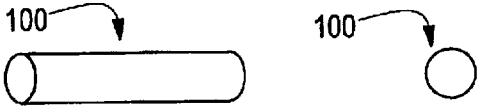
FIG. 7
PRIOR ART
FIG. 6
PRIOR ART
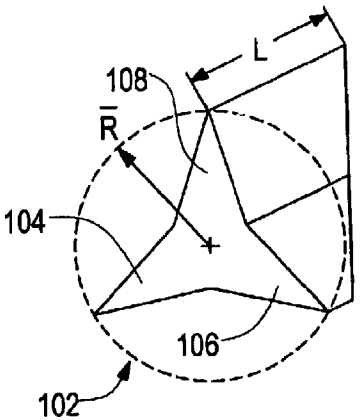
FIG. 8
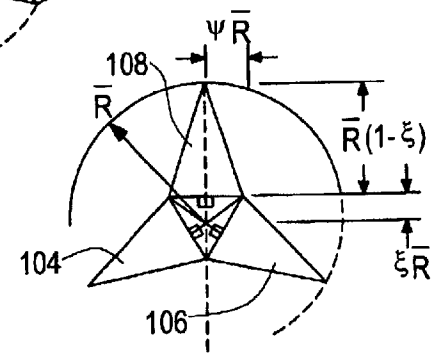
FIG. 9
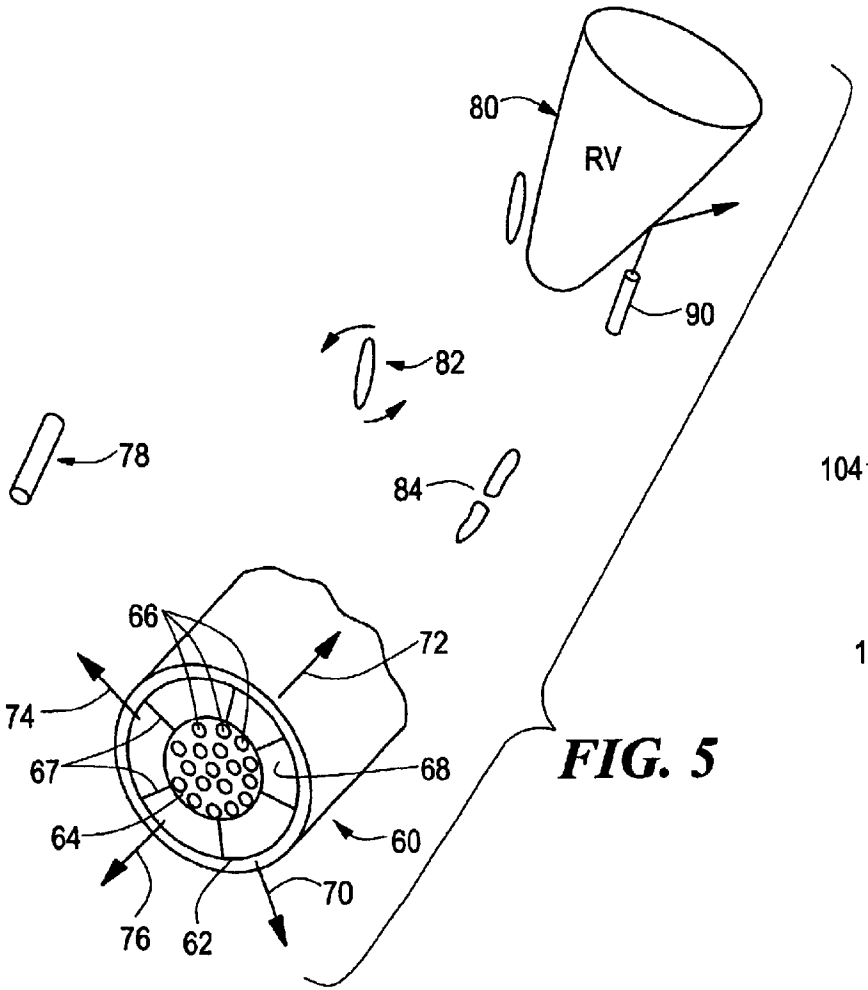
FIG. 5

FIG. 31
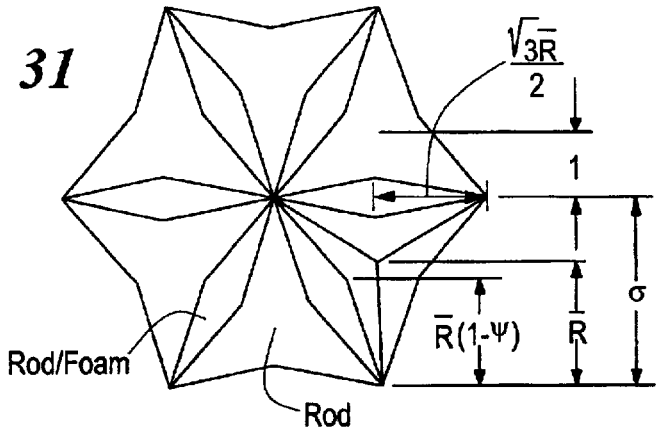
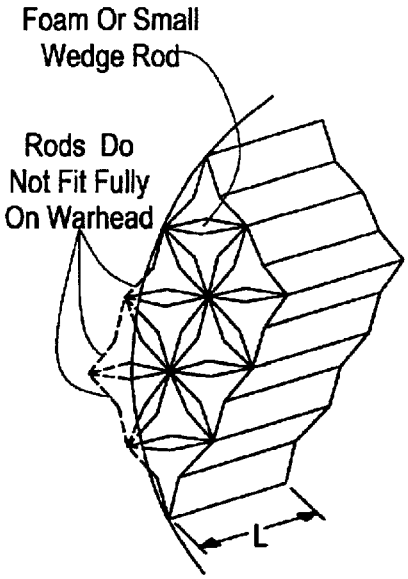
FIG. 32
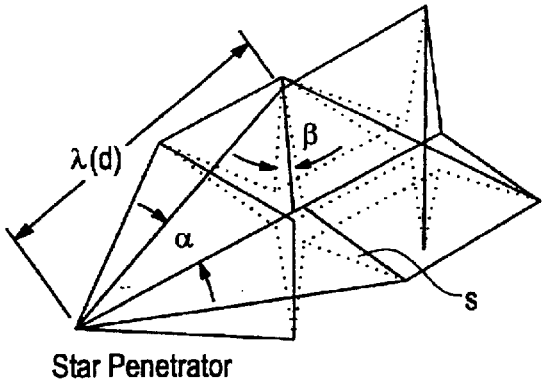
FIG. 33
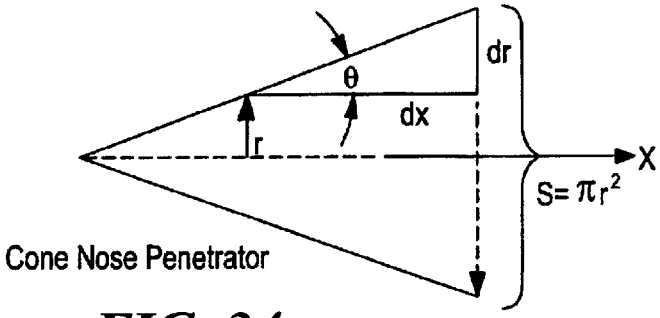
FIG. 34

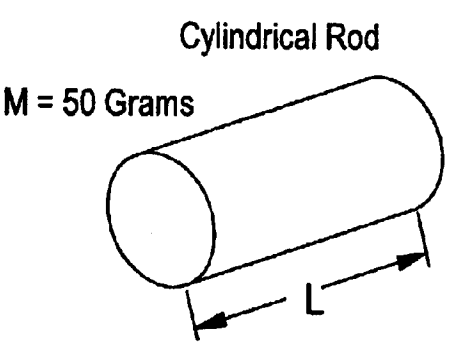
FIG. 35
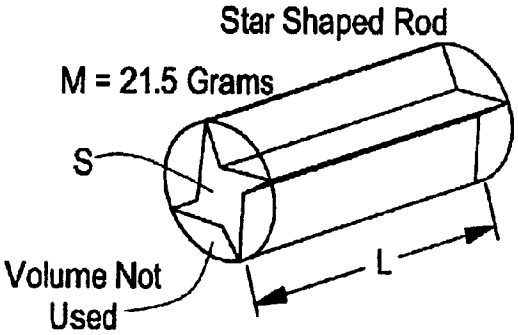
FIG. 36
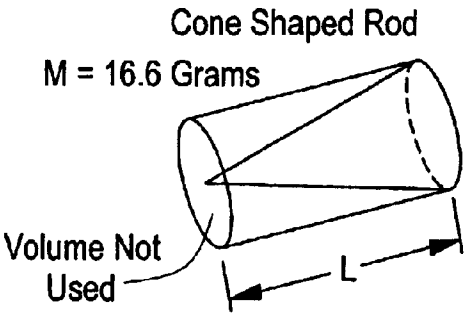
FIG. 37
FIG. 38
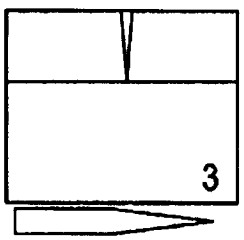
FIG. 39
FIG. 40
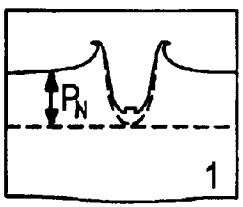
FIG. 41
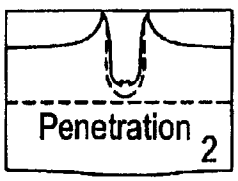
FIG. 42
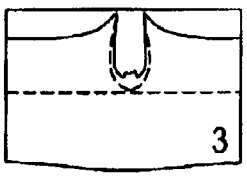
FIG. 43

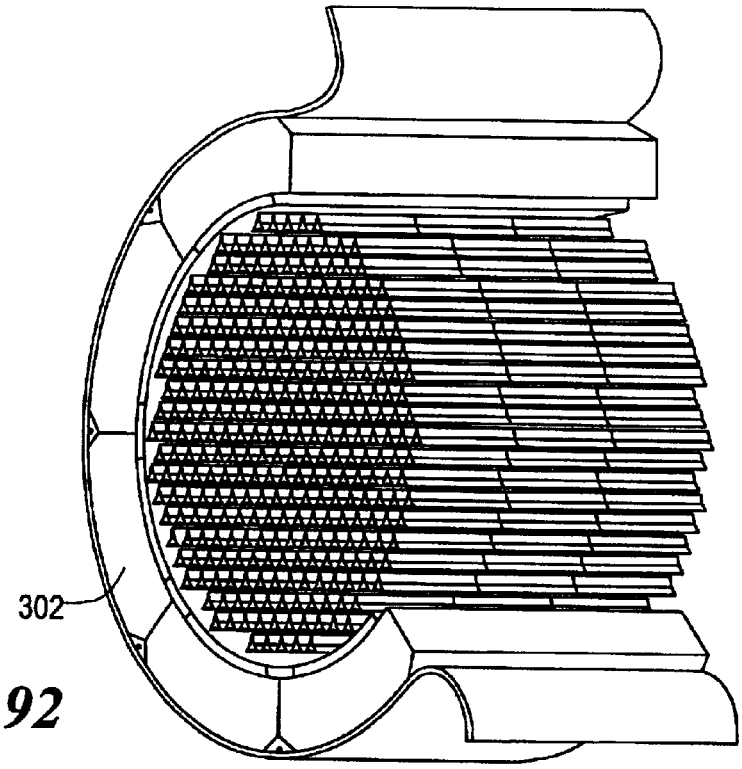
FIG. 92
FIG. 93
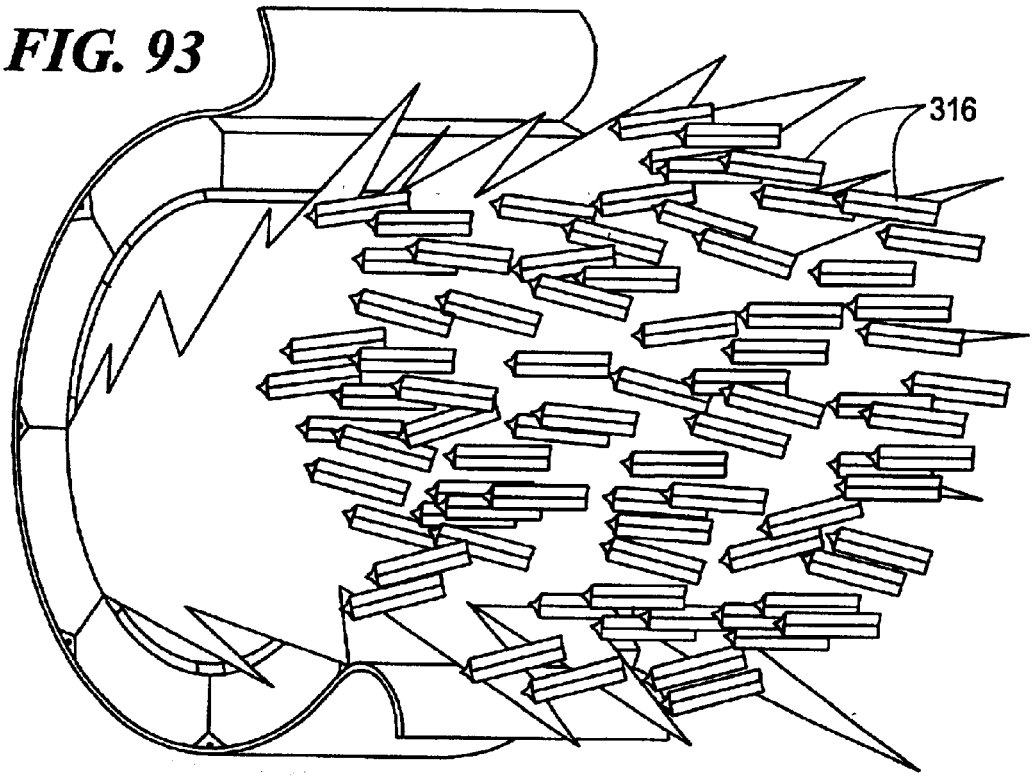

KINETIC ENERGY ROD WARHEAD WITH OPTIMAL PENETRATORS

RELATED APPLICATIONS

This application claims priority of Provisional Application Serial No. 60/295,731 filed Jun. 4, 2001 now abandoned. This application is related to application Ser. No. 09/938,022 filed Aug. 23, 2001, incorporated herein by this reference.

FIELD OF THE INVENTION

This invention relates to improvements in kinetic energy rod warheads.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads.

"Hit-to-kill" vehicles are typically launched into a position proximate a re-entry vehicle or other target via a missile such as the Patriot, Trident or MX missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some "hit-to-kill" threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the target and, again, biological bomblets and/or chemical submunition payloads survive and cause heavy casualties.

The textbooks by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, and "Physics of Direct Hit and Near Miss Warhead Technology", Volume 194, ISBN 1-56347-473-5, incorporated herein by this reference, provide additional details concerning "hit-to-kill" vehicles and blast fragmentation type warheads. Chapter 5 and Chapter 3 of these textbooks propose a kinetic energy rod warhead.

The two primary advantages of a kinetic energy rod warhead is that 1) it does not rely on precise navigation as is the case with "hit-to-kill" vehicles and 2) it provides better penetration then blast fragmentation type warheads.

To date, however, kinetic energy rod warheads have not been widely accepted nor have they yet been deployed or fully designed. The primary components associated with a theoretical kinetic energy rod warhead is a hull, a projectile core or bay in the hull including a number of individual lengthy cylindrical projectiles, and an explosive charge in the hull about the projectile bay with sympathetic explosive shields. When the explosive charge is detonated, the projectiles are deployed.

The projectiles, however, may tend to break and/or tumble in their deployment. Still other projectiles may approach the target at such a high obliquity angle that they do not effectively penetrate the target. See "Aligned Rod Lethality Enhanced Concept for Kill Vehicles," R. Lloyd "Aligned Rod Lethality Enhancement Concept For Kill Vehicles" $10^{th}$ AIAA/BMDD TECHNOLOGY CONF., July 23–26, Williamsburg, Va., 2001 incorporated herein by this reference. To date, the focus has been on long cylindrical flat ended projectiles with a high length to diameter ratio. This shape for the projectiles, however, is not optimized from the standpoint of strength, weight, packaging efficiency, penetrability, and lethality.

SUMMARY OF THE INVENTION

It is therefore an object of this invention to provide an improved kinetic energy rod warhead.

It is a further object of this invention to provide a higher lethality kinetic energy rod warhead.

It is a further object of this invention to provide a kinetic energy rod warhead with penetrators optimized in shape to improve on the strength, weight, packaging efficiency, penetrability, and lethality of prior art cylindrical cross section projectiles.

It is a further object of this invention to provide such a kinetic energy rod warhead which is capable of aligning and selectively directing the projectiles at a target.

It is a further object of this invention to provide such a kinetic energy rod warhead which prevents the projectiles from breaking when they are deployed.

It is a further object of this invention to provide such a kinetic energy rod warhead which prevents the projectiles from tumbling when they are deployed.

It is a further object of this invention to provide such a kinetic energy rod warhead which insures the projectiles approach the target at a better penetration angle.

It is a further object of this invention to provide such a kinetic energy rod warhead which can be deployed as part of a missile or as part of a "hit-to-kill" vehicle.

It is a further object of this invention to provide such a kinetic energy rod warhead with projectile shapes which have a better chance of penetrating a target.

It is a further object of this invention to provide such a kinetic energy rod warhead with projectile shapes which can be packed more densely.

It is a further object of this invention to provide such a kinetic energy rod warhead which has a better chance of destroying all of the bomblets and chemical submunition payloads of a target to thereby better prevent casualties.

The invention results from the realization that a higher lethality and lower weight kinetic energy rod warhead can be effected by the inclusion of penetrators having non-cylindrical cross sectional shapes and/or pointed ends and which can be packaged more efficiently. This invention results from the further realization that a higher lethality kinetic energy rod warhead can be effected by the inclusion of means for aligning the individual projectiles when they are deployed to prevent the projectiles from tumbling and to provide a better penetration angle by selectively directing the projectiles at the target.

This invention features a kinetic energy rod warhead comprising a hull, a core in the hull including a plurality of individual penetrators, and an explosive charge in the hull about the core. The penetrators typically have a non-cylindrical cross-section for improved strength, weight, packaging efficiency, penetrability, and/or lethality. In one example, the penetrators have opposing ends at least one of which is pointed. In another example, the penetrators have a tri-star cross-section including three lateral petals spaced 120° apart. Another type of penetrator has a cruciform cross-section including a plurality of petals. There may be four petals each spaced 90° apart. In one example, the petals have a constant width and opposing converging surfaces. In another example, the penetrators have a star cross-section including a number of petals and the star cross-section penetrators have opposing ends at least one of which is pointed or wedge-shaped.

Further included may be means for aligning the individual penetrators when the explosive charge deploys the penetrators. In one example, the means for aligning includes a plurality of detonators spaced along the explosive charge configured to prevent sweepling shock waves at the interface of the core and the explosive charge to prevent tumbling of the penetrators. In another example, the means for aligning includes a body in the core with orifices therein, and the penetrators are disposed in the orifices of the body. In another example, the means for aligning includes a flux compression generator which generates a magnetic alignment field to align the penetrators. Typically, there are two flux compression generators, one on each end of the projectile core and each flux compression generator includes a magnetic core element, a number of coils about the magnetic core element, and an explosive for imploding the magnetic core element.

Typically, the projectiles are made of a low density material. The hull is typically the skin of a missile or a portion of a "hit-to-kill" vehicle. In some embodiments, the explosive charge is outside the core; but in other examples, the explosive charge is inside the core. A low density material buffer material may be disposed between the core and the explosive charge. Typically, the penetrators are lengthy metallic (e.g., tungsten) members.

In the preferred embodiment, the explosive charge is divided into sections and there are shields between each explosive charge section extending between the hull and the projectile core. The shields may be made of a composite material, e.g., steel sandwiched between lexan layers. In another embodiment, the core is divided into a plurality of bays, the explosive charge is divided into a plurality of sections and there is at least one detonator per section for selectively detonating the charge sections to aim the penetrators in a specific direction and to control the spread pattern of the penetrators. Each explosive charge section may be wedged-shaped having a proximal surface abutting the projectile core and a distal surface. The distal surface is typically tapered to reduce weight.

Another kinetic energy rod warhead in accordance with this invention features a hull, a projectile core in the hull including a plurality of individual penetrators, and an explosive charge in the hull about the core. The penetrators have opposing ends at least one of which is pointed and/or the penetrators have a non-cylindrical cross section and opposing ends at least one of which is either non-cylindrical in cross section or, if cylindrical in cross section, non-flat.

Another kinetic energy rod warhead in accordance with this invention features a hull, a core in the hull including a plurality of individual tri-star cross section penetrators, and an explosive charge in the hull about the core.

BRIEF DESCRIPTION OF THE DRAWINGS

Other objects, features and advantages will occur to those skilled in the art from the following description of a preferred embodiment and the accompanying drawings, in which:

FIG. 5 is a more detailed view showing the deployment of the projectiles of a kinetic energy rod warhead at a target in accordance with the subject invention;

FIG. 6 is a schematic view of a prior art cylindrical projectile;

FIG. 7 is an end view of the cylindrical prior art penetrator shown in FIG. 6;

FIG. 8 is an end view of a preferred uniquely shaped penetrator in accordance with the subject invention having a tristar geometry;

FIG. 9 is a cross-sectional view of the tristar penetrator shown in FIG. 8;

FIG. 31 is a cross-sectional view of tristar packing within the warhead detailing the use of separators between the tristars;

FIG. 32 is a view showing non-optimum packaging of the tristar penetrators within a circular space;

FIG. 33 is an illustration showing the particular variables involved in the design of a star penetrator type projectile in accordance with the subject invention;

FIG. 34 is an illustration showing the various design parameters associated with a conical nose type penetrator in accordance with the subject invention;

FIGS. 35–37 are further illustrations showing the design of star rod penetrators and cone shaped rod penetrators in accordance with the subject invention compared to cylindrical cross-section flat ended penetrating rods of the prior art;

FIGS. 38–43 are schematic illustrations showing hydrocode calculations for various shaped penetrators in accordance with the subject invention;

FIGS. 90–93 are schematic three-dimensional views showing how the penetrators of the kinetic energy rod warhead of the subject invention are aimed in a particular direction in accordance with the subject invention;

DISCLOSURE OF THE PREFERRED EMBODIMENT

Figure 1:
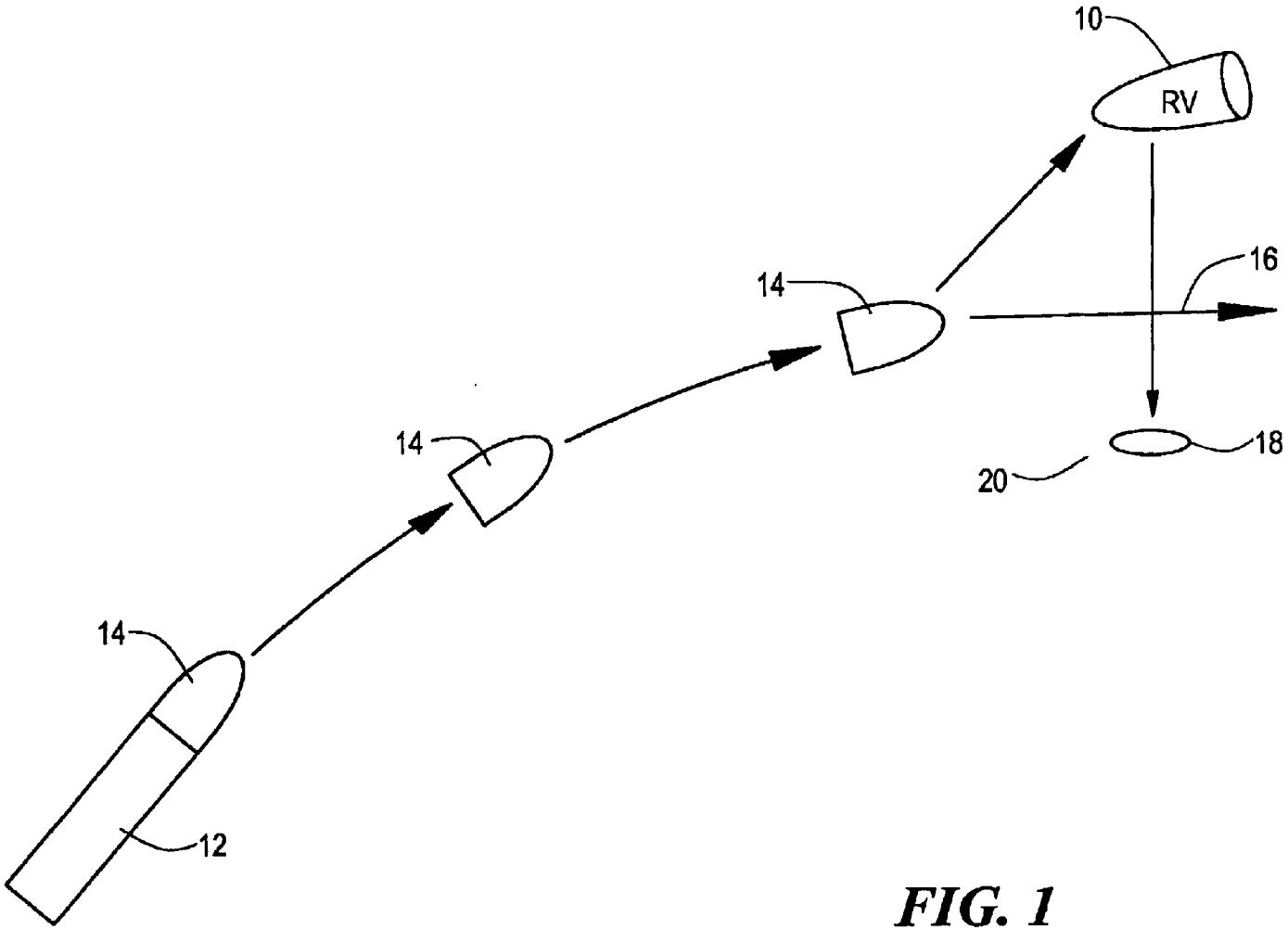
FIG. 1 is a schematic view showing the typical deployment of a "hit-to-kill" vehicle in accordance with the prior art.

As discussed in the Background section above, "hit-to-kill" vehicles are typically launched into a position proximate a re-entry vehicle 10, FIG. 1 or other target via a missile 12. "Hit-to-kill" vehicle 14 is navigable and designed to strike re-entry vehicle 10 to render it inoperable. Countermeasures, however, can be used to avoid the kill vehicle. Vector 16 shows kill vehicle 14 missing re-entry vehicle 10. Moreover, biological bomblets and chemical submunition payloads 18 are carried by some threats and one or more of these bomblets or chemical submunition payloads 18 can survive, as shown at 20, and cause heavy casualties even if kill vehicle 14 does accurately strike target 10.

Figure 2:
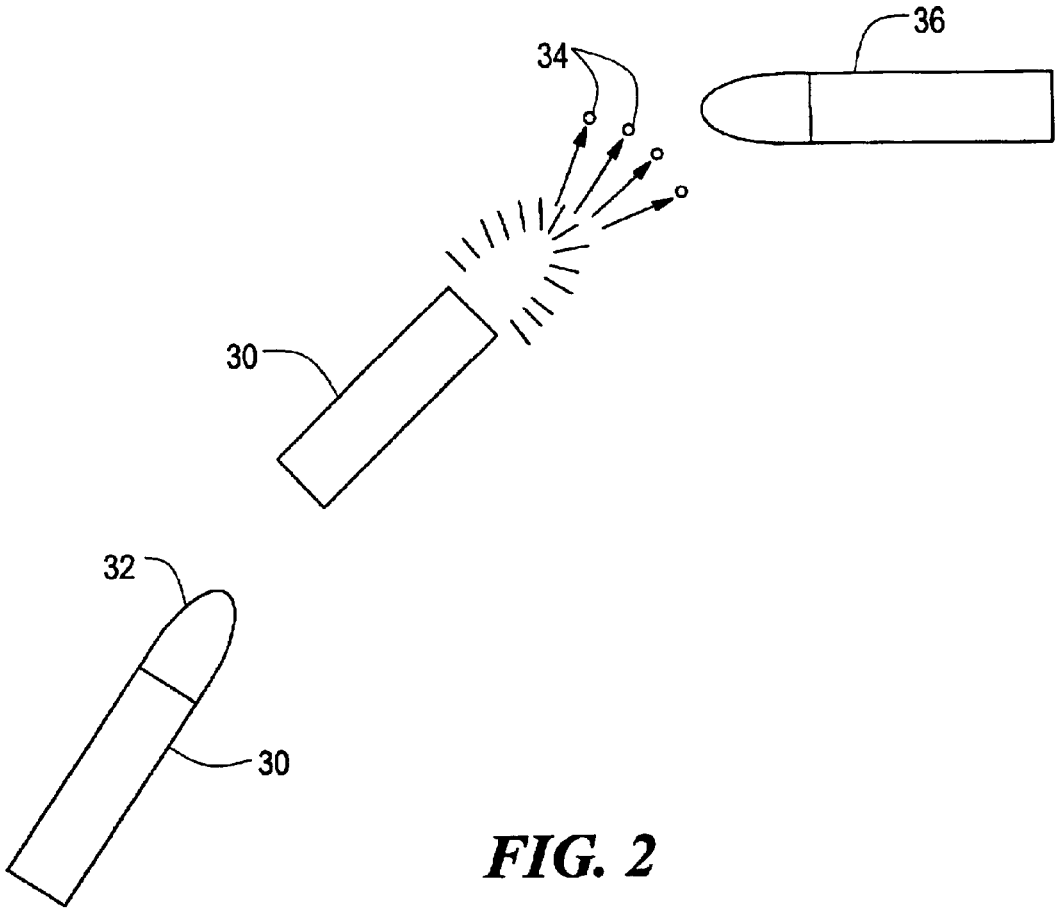
FIG. 2 is a schematic view showing the typical deployment of a prior art blast fragmentation type warhead.

Turning to FIG. 2, blast fragmentation type warhead 32 is designed to be carried by missile 30. When the missile reaches a position close to an enemy re-entry vehicle (RV), missile, or other target 36, a pre-made band of metal or fragments on the warhead is detonated and the pieces of metal 34 strike target 36. The fragments, however, are not always effective at destroying the submunition target and, again, biological bomblets and/or chemical submunition payloads can survive and cause heavy casualties.

The textbooks by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, and "Physics of Direct Hit and Near Miss Warhead Technology" Volume 194, ISBN 1-56347-477-5, incorporated herein by this reference, provide additional details concerning "hit-to-kill" vehicles and blast fragmentation type warheads. Chapter 5 and Chapter 3 of these textbooks propose a kinetic energy rod warhead.

Figure 4:
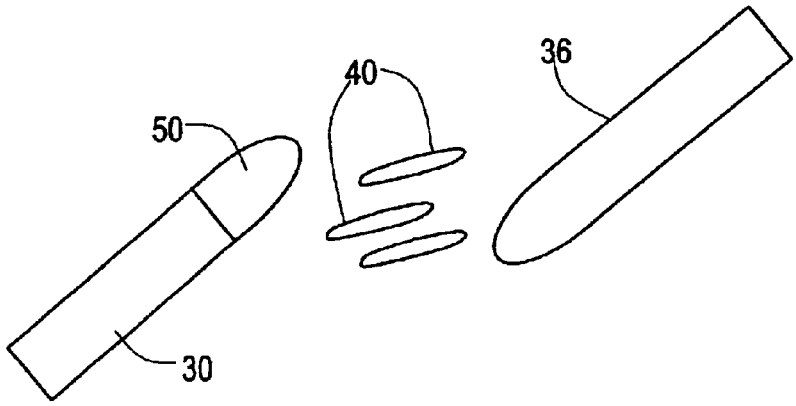
FIG. 4 is a schematic view showing the deployment of a kinetic energy rod warhead as a replacement for a blast fragmentation type warhead in accordance with the subject invention.
Figure 3:
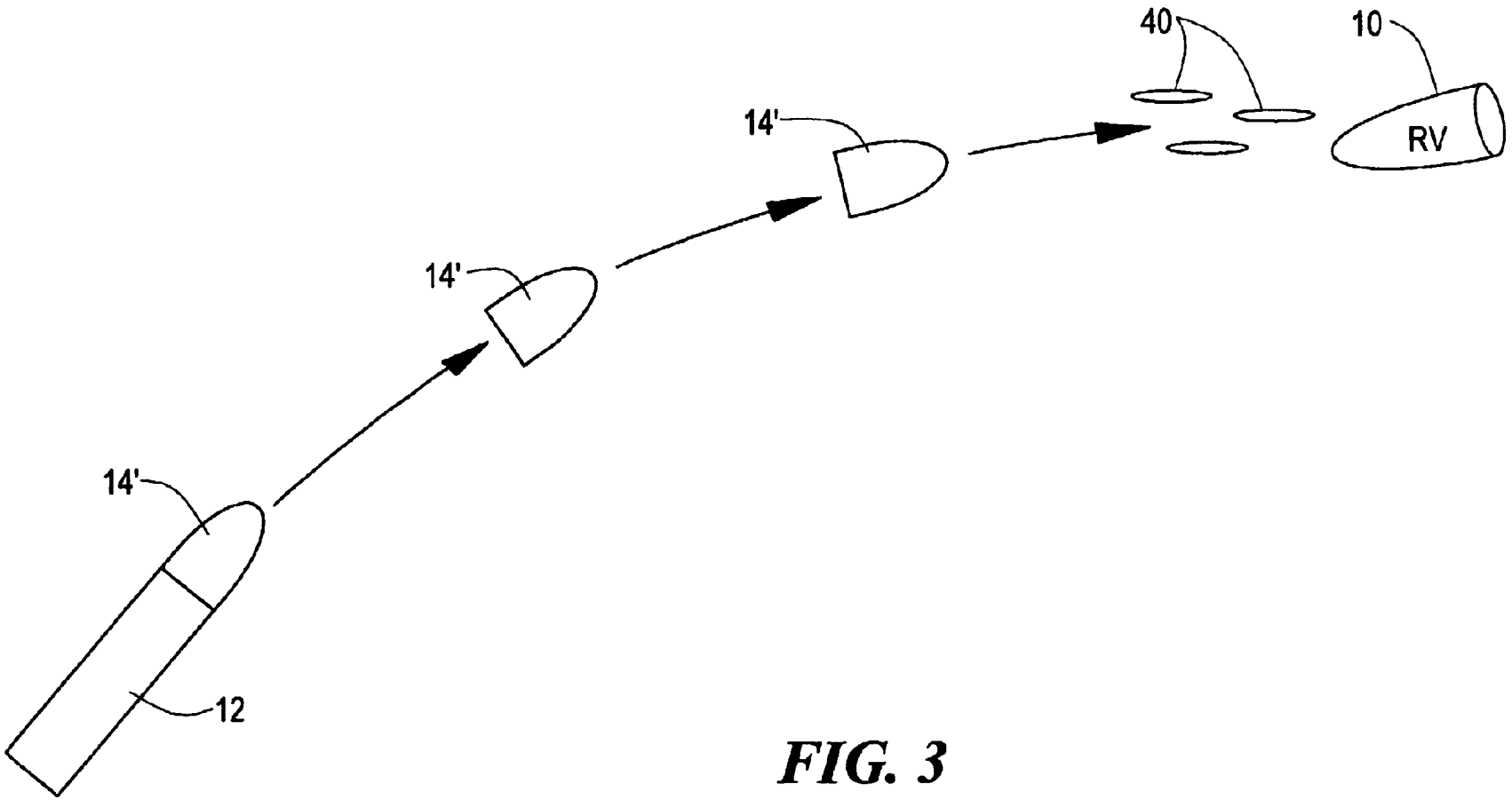
FIG. 3 is a schematic view showing the deployment of a kinetic energy rod warhead system incorporated with a "hit-to-kill" vehicle in accordance with the subject invention.

In general, a kinetic energy rod warhead, in accordance with this invention, can be added to kill vehicle (interceptor) 14', FIG. 3 to deploy lengthy cylindrical projectiles 40 directed at re-entry vehicle 10 or another target. In addition, the prior art blast fragmentation type warhead shown in FIG. 2 can be replaced with or supplemented with a kinetic energy rod warhead 50, FIG. 4 to deploy projectiles 40 at target 36.

Two key advantages of kinetic energy rod warheads as theorized is that 1) they do not rely on precise navigation as is the case with "hit-to-kill" vehicles and 2) they provide better penetration then blast fragmentation type warheads.

Before the invention disclosed herein, however, kinetic energy rod warheads had not been widely accepted nor have they yet been deployed or fully designed. The primary components associated with a theoretical kinetic energy rod warhead 60, FIG. 5 is hull 62, projectile core or bay 64 in hull 62 including a number of individual lengthy cylindrical flat-end rod projectiles 66, shield members 67, and explosive charge 68 in hull 62 about bay or core 64 and separated by shield members 67. When explosive charge 66 is detonated, projectiles 68 are deployed as shown by vectors 70, 72, 74, and 76.

Note, however, that in FIG. 5 the projectile shown at 78 is not specifically aimed or directed at re-entry vehicle 80. Note also that the cylindrical shaped projectiles may tend to break upon deployment as shown at 84. The projectiles may also tend to tumble in their deployment as shown at 82. Still other projectiles approach target 80 at such a high oblique angle that they do not penetrate target 80 effectively as shown at 90.

Studies conducted by the inventors hereof have proven that the use of cylindrical, flat-end projectile 100, FIGS. 6–7 is not optimized in shape from the standpoint of strength, weight, packaging efficiency, penetrability, and lethality. Accordingly, in accordance with this invention, novel penetrators typically having non-cylindrical cross-sections are disclosed.

One such penetrator is a tristar shaped cross-section penetrator 102, FIGS. 8–9 which has three lateral petals 104, 106, and 108 each preferably spaced 120° apart. Another such penetrator 110, FIG. 10 has a cruciform shaped cross-section including four constant width cross petals 112, 114, 116, and 118 spaced 90° apart. The star cruciform penetrator 130 shown in FIG. 11 also has four petals 132, 134, 136, and 138 each, as shown for petal 138, having opposing surfaces 140 and 142 which converge to edge 144. As shown, surface 140 is larger than surface 142.

Figure 13:
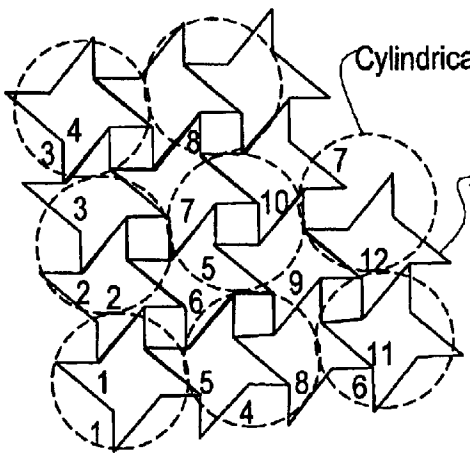
FIG. 13 is a schematic view showing the packaging efficiency of star-shaped penetrators in accordance with the subject invention compared to cylindrical cross-shaped rod penetrators of the prior art.
Figure 12:
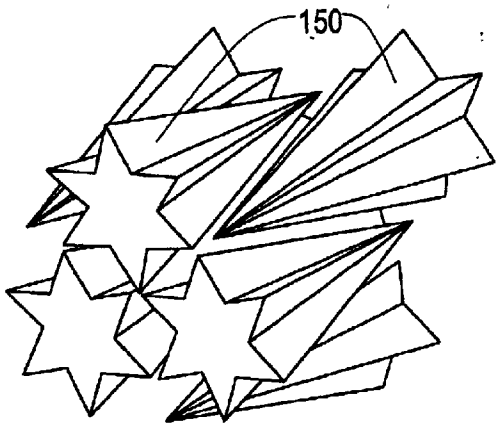
FIG. 12 is a schematic view depicting a number of packaged star cross-section pointed end penetrators in accordance with the subject invention.
Figure 14:
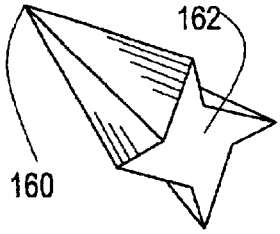
FIG. 14 is another schematic view of a tristar penetrator in accordance with the subject invention.
Figure 15:
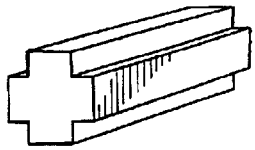
FIG. 15 is a schematic view of another cruciform shaped penetrator in accordance with the subject invention.
Figure 16:
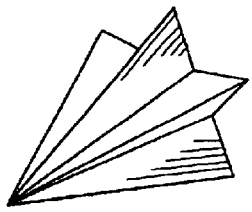
FIG. 16 is a schematic view of a star nose shaped penetrator in accordance with the subject invention.
Figure 17:
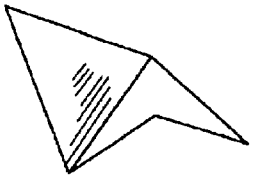
FIG. 17 is a schematic view of another non-cylindrical cross-section penetrator in accordance with the subject invention.
Figure 18:
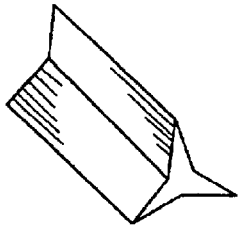
FIG. 18 is a schematic view showing another embodiment of a star cruciform penetrator in accordance with the subject invention.
Figure 19:
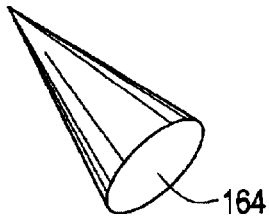
FIG. 19 is a schematic view showing a cylindrical cross-section penetrator in accordance with the subject invention but having a pointed or wedge-shaped penetrating end.
Figure 20:
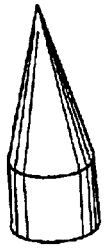
FIG. 20 is a schematic view of another cylindrical cross-section penetrator in accordance with the subject invention but having a pointed end.
Figure 21:
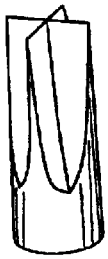
FIG. 21 is a schematic view of a cylindrical cross-section penetrator in accordance with the subject invention having a non-cylindrical cross-section penetrating end.
Figure 22:
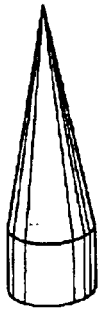
FIG. 22 is a schematic view of still another cylindrical cross-section penetrator in accordance with the subject invention having a pointed end.
Figure 23:
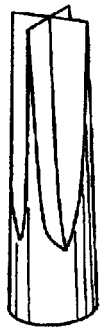
FIG. 23 is a schematic view of another cylindrical cross-section penetrator in accordance with the subject invention having a non-cylindrical cross-section penetrating end.
Figure 24:
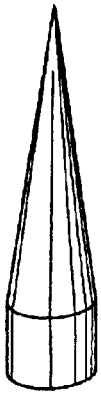
FIG. 24 is a schematic view of another cylindrical cross-section penetrator in accordance with the subject invention but having an extended tapered pointed penetrating end.
Figure 25:
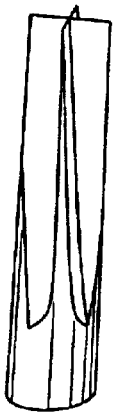
FIG. 25 is a schematic view showing another polly-wedge nose type penetrator in accordance with the subject invention.
Figure 26:
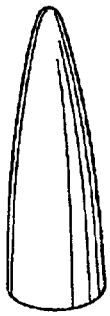
FIG. 26 is a schematic view showing a penetrator in accordance with the subject invention having a conical shaped penetrating nose.
Figure 27:
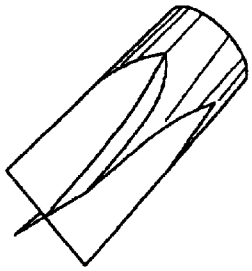
FIG. 27 is a schematic view of another polly-wedge nose shaped penetrator in accordance with the subject invention.

The star penetrators 150 shown in FIGS. 12 and 13 have petals with opposing surfaces of equal but varying widths and thus one end of each such penetrator is pointed as shown. FIGS. 14–29 show other possible penetrator shapes. FIG. 14 shows a tristar shaped penetrator having a pointed distal end 160 and a flat proximal end 162. FIG. 15 shows a cruciform type penetrator with both ends flat. FIG. 16 shows a star nose style penetrator; FIG. 17 shows a flying wing shaped penetrator; FIG. 18 shows a star penetrator having two flat ends; and FIG. 19 shows a penetrator in accordance with the subject invention having a cylindrical cross-section body but wedge shaped distal penetrating end 164. Portions of the penetrators shown in FIGS. 20–27 have a cylindrical cross-section but, in each case, the nose thereof has an improved penetrating shape. For example, FIGS. 20, 22, and 24 depict pointed penetrating noses while FIGS. 21, 23, and 25 depict polywedge nose shaped penetrators of various sizes. FIG. 26 also shows a conic nose shaped penetrator and FIG. 27 shows, from a different perspective, another polywedge nose type penetrator.

There are several distinct advantages achieved by the penetrator shapes shown in FIGS. 14–27 when used in kinetic energy rod warheads: higher strength, lower weight, better packaging efficiency, greater penetrability, and higher lethality. Returning to FIGS. 12 and 13, these new rod shape concepts were compared to a prior art cylindrical rod from a packaging and penetration perspective. The packaging strategy is based on how efficient a novel star-like penetrator fits into a pre-selected cylindrical rod volume. For example, if a 50 gm cylindrical rod with a length to diameter (L/D) ratio of 5 is considered, then the star-shaped concept of this invention (FIG. 12) is designed within theses geometric volume limits. Each star-shaped rod now weighs less than 50 gm and if it achieves similar or equal penetration characteristics, then lighter weight rods are proven to be more efficient. This reduced weight can now be used to add more star-shaped rods to the warhead. These added rods increase the target damage by increasing the overall spray density at target impact. The star-like rods are packaged on the warhead as close as possible to ensure maximum packaging. Packaging studies conducted by the inventors hereof showed how well the novel rods of the subject invention fit into a cylindrical rod volume with a radius r. A representative packaging comparison between a cylindrical and star-shaped rod is shown in FIG. 13. The packaging scheme demonstrated that 12 star-shaped penetrators could be packaged in a warhead compared to 7 prior art cylindrical shaped rods. Even though there are more star-shaped penetrators, however, the star-shaped rods weigh less when compared to cylindrical rods. Thus, if star-like rods achieve near similar overall penetration compared to cylindrical rods, they would have a higher lethality.

The next penetrator shape studied is a star cruciform which contains a rectangular rod surrounded by four longitudinal petals. The total mass of the rod is based on the radius r and three dimensionless constants are introduced to determine the overall length and width of the rod relative to the outer radius r. The design and mathematical logic is shown in Progress In Astronautics and Aeronautics (AIAA) Vol. 194.

Future missile systems are being designed to achieve direct hits against all ballistic missile intercepts. However, there could exist missile engagement conditions where a warhead concept may be required. An aimable kinetic energy rod warhead deploys 30 times more mass in the direction of the target when compared to traditional blast fragmentation warheads. These warheads contain an inner core of high-density penetrators surrounded by explosives. Depending on the target azimuthal direction about the warhead will determine which explosive packs to detonate. The explosive packs are detonated and all the rods are deployed in the direction of the target. This aimable rod warhead concept contains a small explosive charge (C) to mass (M) ratio (C/M=0.2). The rods are deployed between 200 to 500 ft/sec and they rely on the relative engagement velocity to supply their penetration power.

The rods deployed from the aimable rod warhead randomly tumble. However, new alignment techniques discussed herein can be applied to generate a distribution of rods aligned along the relative velocity vector. These rods can now penetrate deeper into a ballistic missile payload compared to random orientated distributions.

Our studies showed the rods of FIGS. 8–27 package more efficiently in a kinetic energy rod warhead compared to cylindrical rods. These novel shaped rods are designed with many different cross-sections, such as tristar, cruciform and triform. There also exists another class of unique cross-sectionally shaped penetrators which are star-like. These star-shaped rods contain noses that are polywedge or helical shaped. This new class of rods can be designed into many different shapes as shown in FIGS. 14–27.

These new rod concepts are compared to the baseline cylindrical rod from a packaging and penetration perspective. The packaging strategy is based on how efficient the penetrator of this invention fits into a preselected cylindrical rod volume. For example, if a 50 gm cylindrical rod with an L/D ratio of 5 is considered, then the star-shape concept is designed within these geometric volume limits.

The rod now weighs less then 50 gm and if it achieves similar or equal penetration characteristics, then lighter weight rods are more efficient. This reduced weight is now used to add more star-shaped rods to the warhead. These added rods increase the target damage by increasing overall spray density at target impact. The star-like rods are packaged on the warhead as close as possible to ensure maximum packaging. Our packaging studies compared how well a novel rod fits into a cylindrical rod volume with radius r. A representative packaging comparison between a cylindrical and star-shape rod is shown in FIGS. 12–13.

Figure 10:
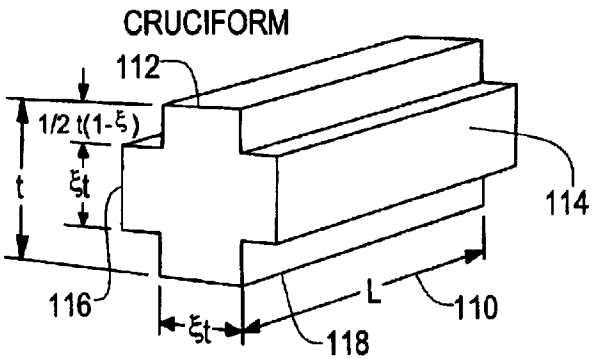
FIG. 10 is a schematic view of a novel cruciform shaped penetrator also in accordance with the subject invention.

The packaging scheme demonstrated that 12-star penetrators could be packaged on a rod warhead compared to eight cylindrical shaped rods. Obviously, given a constant warhead weight, there would be many more star-shaped rods. However, the star-shaped rods would weigh less compared to a cylindrical rod. If the star-like rods can achieve near similar overall penetration compared to the cylindrical rod, then it would be a more lethal kill mechanism. A mass comparison can be made for a selected set of Novel penetrator shapes. A description of these penetrators is shown in FIGS. 10 and 11 in relation to equations (1)–(5).

Figure 11:
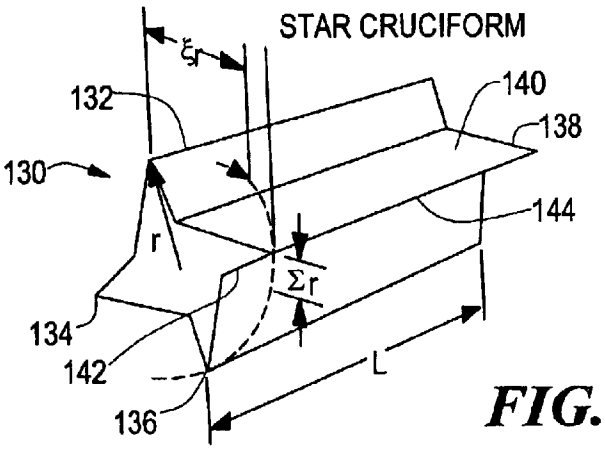
FIG. 11 is a schematic view of a star cruciform shaped penetrator in accordance with the subject invention.

The star cruciform is shown in FIG. 11 and inscribed inside the cylindrical rod with radius r.

The tristar rod is another novel shape that can be designed as a rod and contained in an amiable rod warhead. This configuration contains three lateral petals which are spaced 120° apart. A description of a tristar rod showing its cross-sectional area is shown in FIGS. 8–9.

Figure 28:
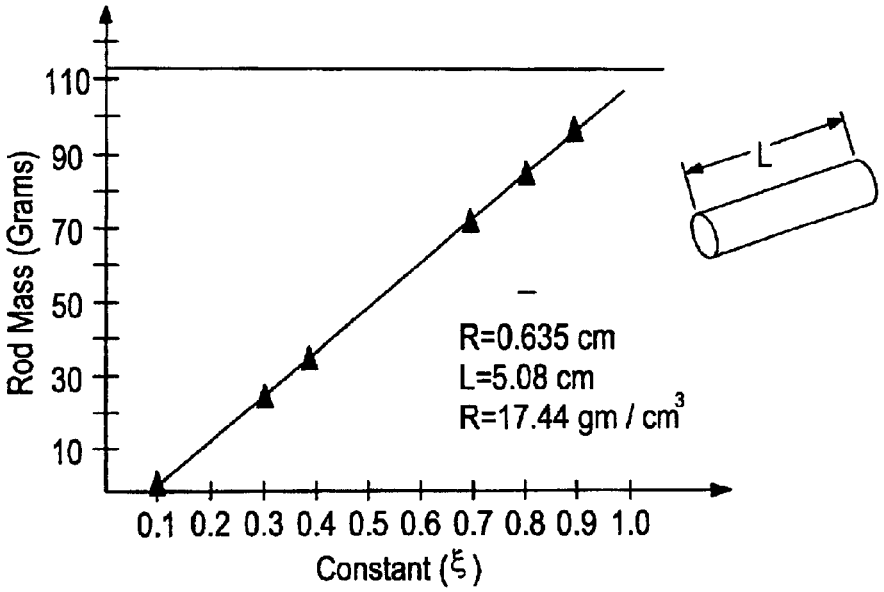
FIG. 28 is a graph showing the mass of a tristar type penetrator compared to the mass of a cylindrical cross-section prior art penetrator.
Figure 29:
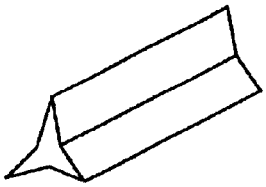
FIG. 29 is a view of the tristar type penetrator used to generate the graph of FIG. 28.

The mass of the tristar rod shown in FIG. 29 is a function of constant $\xi$ and is shown in FIG. 28. These curves compare the mass of a cylindrical rod to a tristar while varying constant $\xi$.

When the rods inner web thickness constant $\xi$ approaches 1.0, its mass becomes equal to that of a cylindrical rod.

The packaging of these rods is now considered where a matrix of tristar rods is placed inside the central core. These rods are packaged inside the warhead but there does exist small air gaps between each neighboring rod. These air gaps are filled with foam or a smaller platelet rod.

Figure 30:
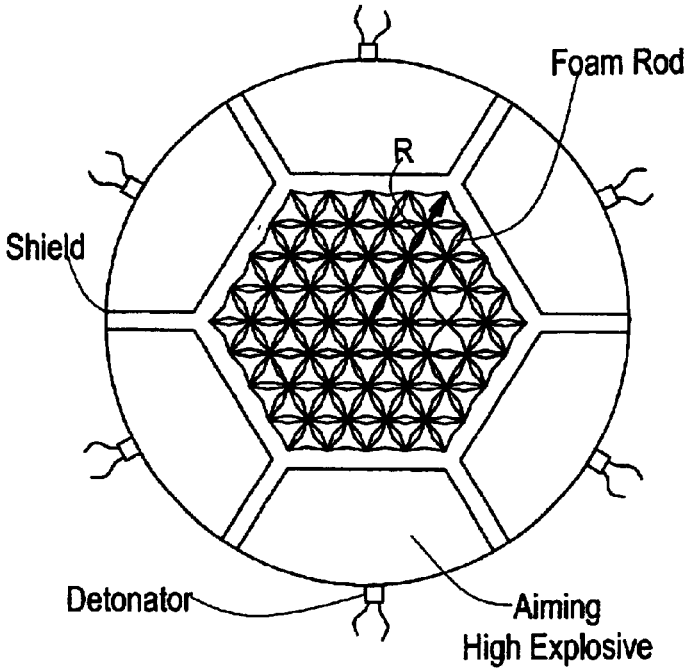
FIG. 30 is a schematic view showing the primary components associated with a kinetic energy rod warhead of the subject invention including tristar type penetrators packaged in the core thereof.

The foam would prevent any fracture that may occur from initial deployment. A description of a rod warhead filled with tristars is shown in FIGS. 30–31.

The total number of rods estimated in the warhead can be calculated based on radius R. The length of each wing on the tristar is $\overline{R}$. There does exist a small thickness which occupies the sold region of the web thickness. This thickness is $\overline{R}$ where the wing length is now $\overline{R}(1-\xi)$. The total number of rods in the horizontal direction is computed first. The distance between each rod is $\sqrt{3}\overline{R}/2$ which is derived in the above cited textbook.

The estimated total number of rods is computed based on the vertical and horizontal distances.

However, the stacking efficiency of the rods inside the warhead area without partial fits is approximately 0.85. This calculation is based on a circular area with full rods counting as fits. An illustration of partial tristar rods on the warhead is shown in FIG. 32.

There exist mathematical equations (Russian origin) that predict the total penetration performance of cylindrical and star-like penetrators. These equations provide a first principle mathematical process to compute total penetration for nontrivia shaped rigid penetrators. Our studies have focused on bench marking these equations to actual test data with hydrocode calculations. Also, these equations are only valid for normal penetration.

A description of a star and cone penetrator defining all the variables is shown in FIGS. 33–34.

A comparison was made between total penetration of three different penetrator shapes. These three different shapes are shown in FIGS. 35–37. The Russian origin equations were used to calculate the normal penetration of each of these penetrators. The total volume is held constant and the rod mass varied relative to the baseline cylindrical volume. The rods and the target plate were all made of standard 4130 steel. The cylindrical rod mass is 50 gm while the cruciform rod weight is 21.5 gm and the cone penetrator is 16.6 gm. The overall length of each penetrator is equal to 2.31 inches while their radius is 0.231 inches. The cylindrical rod was fired into a steel plate at 2.1 km/sec and the Wollmen (ISL) penetration model predicted 2.35 inches of overall penetration. The Russian equation predicted the cylinder would penetrate 2.51 inches. This equation also predicted the cruciforn rod would penetrate up to 2.44 inches. This rod configuration is 56.8 percent lighter compared to the cylindrical rod. The penetrator has less overall resistance to penetration but its mass dropped to 16.6 gm. This rod is 67 percent lighter compared to the cylindrical rod. The cone shaped rod penetrated 2.08 inches. There exists a race between the penetrator mass and the resistance factor $K_o$. The HULL hydrocode was used to investigate the total penetration of these two different conic projectile shapes relative to a cylinder. The calculation computed similar depths to within 6 percent, when compared to the Russian equation. A description of these hydrocode runs is shown in FIGS. 38–43.

Figure 44:
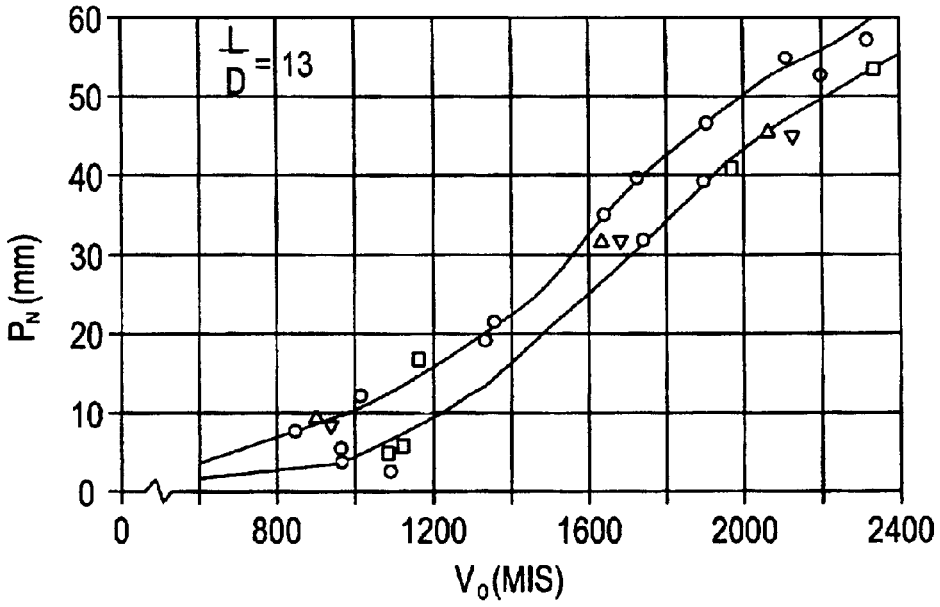
FIG. 44 is a graph showing penetrator depth as a function of impact velocity for the penetrators of the subject invention.
Figure 45:
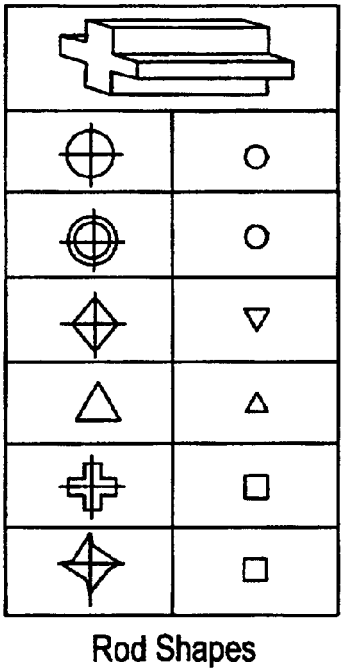
FIG. 45 is a table associated with the graph of FIG. 44 showing the meaning of the legends on the graph of FIG. 44.
Figure 46:
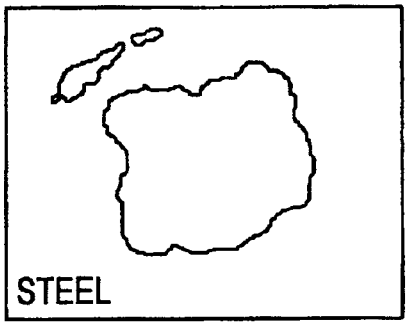
FIGS. 46 and 47 are schematic views showing the hole profiles created by star shaped penetrators in accordance with the subject invention.
Figure 47:
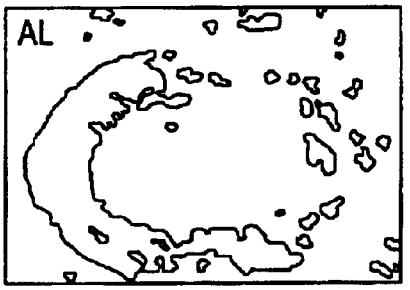

The $K_o$ value of the conic noses increases the penetration mathematically, however, the cone rod is losing mass quicker and overall penetration is reduced. These calculations show the basic mechanics of designing rods and further work is required to correlate the equations of Star-Like penetrators to hydrodynamic limits. As the impact velocity increases past the hydrodynamic limit, the effects of nose shape becomes minimized. There was testing of six different rod configurations where $K_o$=1.0 and a comparison was made to a solid cylindrical rod. The results of these tests with a profile of the hole in a target plate is shown in FIGS. 44–46.

The novel rod configurations of this invention penetrated similar overall depths compared to the cylindrical rod. This demonstrates that if all the rods deployed from a rod warhead could be aligned, there would be a benefit from reducing the overall mass of each penetrator. The crater profiles against aluminum and steel target plates of a star penetrator is also shown.

If high obliquity is combined with yaw, there are potential edge effects that may reduce the overall rods penetration. There exists axial loading, erosion and extrusion shear mechanisms that cause long rods to bend and potentially break. This severe bending decreases the overall penetration after it has penetrated a single plate. Raytheon has been investigating the use of novel penetrators to address these potential limitations. These new rod cross-sections show much promise in holding the penetrator together longer compared to traditional cylindrical rods. Their moment of inertia is higher, leading to greater rod stiffness and stability, especially when compared to cylindrical rods.

The SPHINX hydrocode was run to calculate tungsten rod penetration through thin steel plates when combining both obliquity and yaw angles. The idea is to determine if the penetrator stays together after perforation of a thin plate with obliquity and yaw. A tungsten rod with an L/D of 30 was fired into a steel plate at 3 km/sec. The plate thickness was 4.9 mm and its obliquity angle was 60°. The first calculation did not contain any yaw. The rod held together and was stable after it penetrated the steel plate.

The same calculation was performed with a 6.0° yaw. The rod easily penetrated the steel plate but there was some bending on the nose of the rod. The curved section of the rod would slightly reduce its overall penetration performance.

Figure 48:
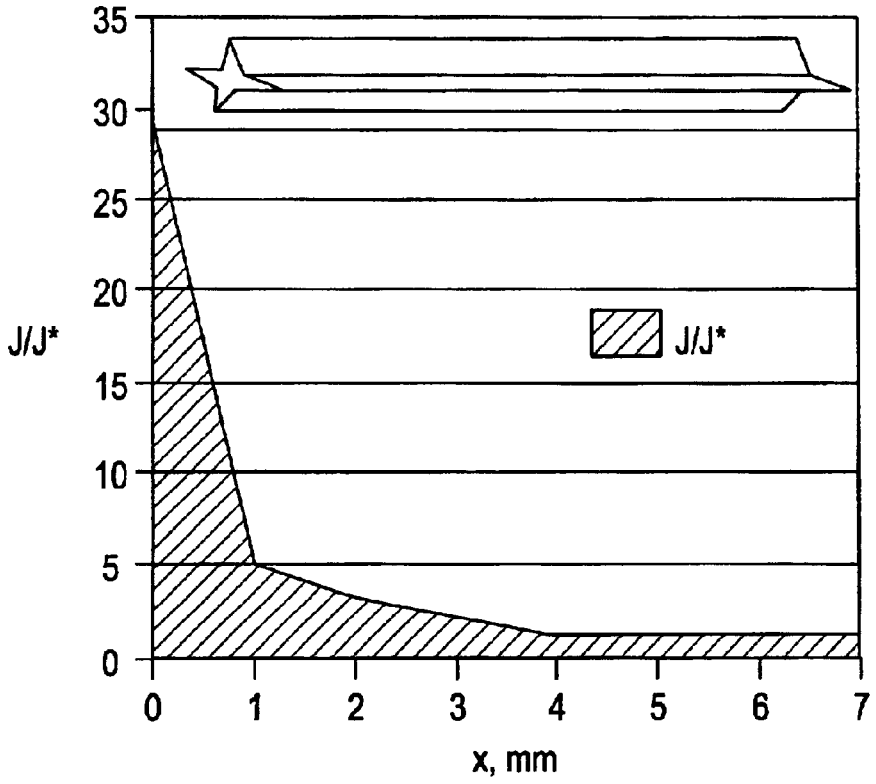
FIG. 48 is a graph showing the increased moment of inertia of a star-shaped penetrator compared to a cylindrical cross-section penetrator.
Figure 49:
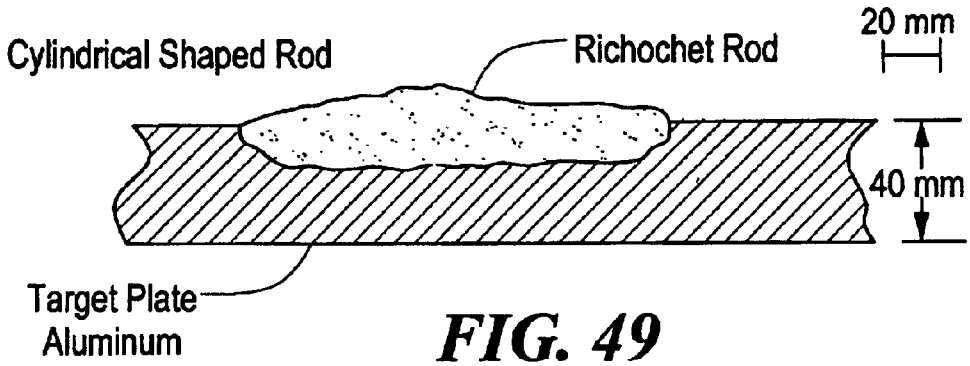
FIG. 49 is an illustration showing the minimal impact damage caused by a cylindrical cross-section penetrator of the prior art in an aluminum target plate.
Figure 50:
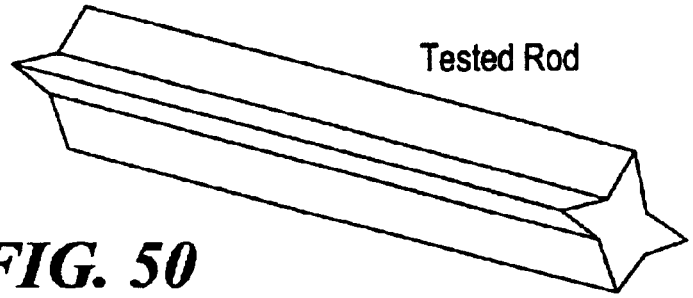
FIG. 50 is a schematic view of a novel non-cylindrical cross-section penetrator tested in accordance with the subject invention.
Figure 51:
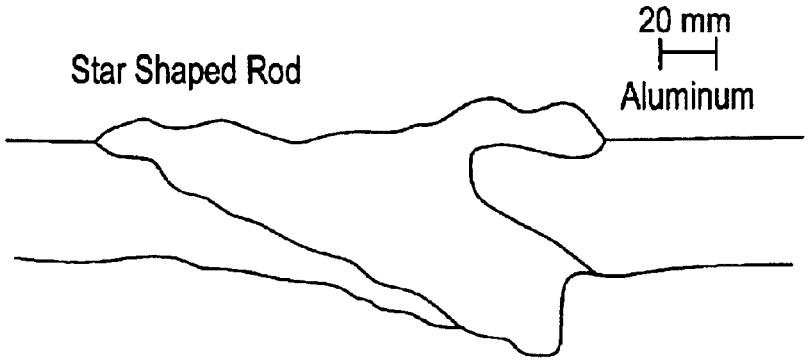
FIG. 51 is a schematic view showing the hole caused by the penetrator shown in FIG. 50 in an aluminum plate.
Figure 52:
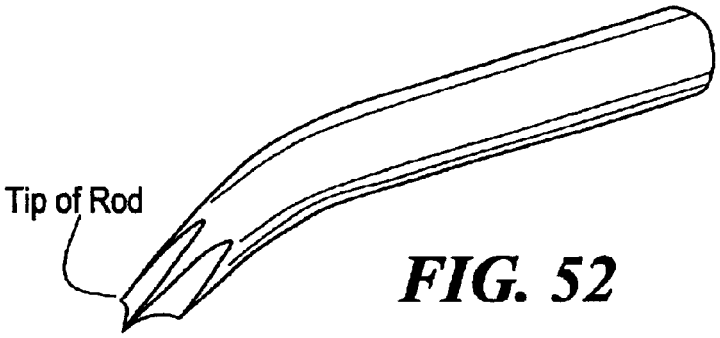
FIG. 52 is a view showing the condition of the penetrator shown in FIG. 50 after it was deployed to strike the aluminum test plate shown in FIG. 51.
Figure 53:
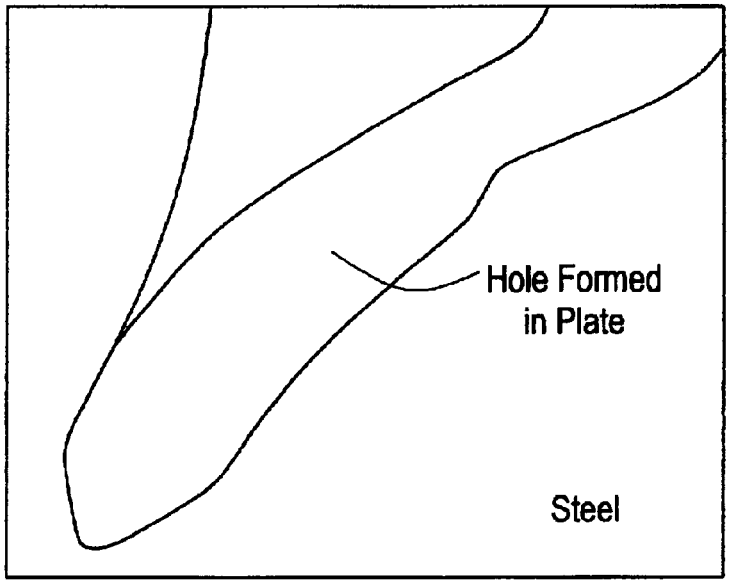
FIG. 53 is a more detailed view showing the level of penetration achieved by the novel penetrator shown in FIGS. 50 and 52.

The third calculation was analyzed with a 16° yaw angle. This calculation demonstrated that thin plates are easily penetrated, but added yaw angles induced a large force on the contact point on the rod. The rod easily penetrated the plate but fractured and broke. Obviously, there would be reduced overall penetration through submunitions or bomblets. This SPHINX calculation is shown in FIG. 48.

These calculations demonstrated that long cylindrical rods must be aligned accurately to gain the added penetration benefit from long rods. Also, new novel or star-like penetrator technology is being considered to reduce the probability of fracturing or breaking.

Cylindrical rods with long L/D ratios have a tendency to bend and break after penetrating a target plate at high obliquity with yaw. Novel penetrators have less tendency to break because their moment of inertia is larger compared to cylindrical rods. The stability of a rigid body penetrator is estimated by $$P_{cr} \cong \frac{\pi^2 E J_y}{\mu L^2} \tag{23}$$

where $J_o$ is the moment of inertia of the cross-section. L is the length, $\mu$ is a dimensionless constant and E is the modulus of elasticity. The moment of inertia is increased with a star-shaped penetrator. Let us consider a four wedge penetrator where its wedge thickness is $$h=\sqrt{2/2}(x \tan \delta) \tag{24}$$

The angle delta (δ) is of declination of an interior edge to the penetrator centerline. The distance x is measured along the axis of the penetrator. The polar moment of inertia of the penetrator is taken along distance x and is calculated by $$J_y = \pi/4R^2 - 4\left\{R^4/8(b-a) + \sqrt{R^2-h^2}\,/12h - h^3/3\left(\sqrt{R^2-h^2-h}\right)\right\} \tag{25}$$

where b=((R2−h2) ½/R) and a=arcsin (h/R). The radius R is the inner foundation of the penetrator. The polar moment of inertia for a cylindrical rod with radius r is $$J_y=(\pi/4)r^4 \tag{26}$$

The polar moment of inertia ratio Jy/Jy is calculated along the a-axis of the penetrator and plotted when δ=12° and R=4 mm. This ratio is shown in FIG. 16.

Experiments were conducted with Star-Like rods and its cylindrical equivalent against a 40 mm aluminum plate. The steel rods were 23 mm in diameter and there Rockwell hardness is 40. Both of these rods were launched at 1630 m/sec normally into an aluminum plate. The star-shape rod made a crater equaling 12 $cm^3$ while the cylindrical shape rod volume is 11 $cm^3$. The next test was conducted at a 45° obliquity angle where the star penetrator created a hole volume of 24 $cm^3$ while the cylindrical rod made 19 $cm^3$. Another test was performed at a 60° obliquity where the cylindrical rod ricocheted while the star-shaped penetrator perforated the aluminum plate. These calculations are shown in FIGS. 49–53.

An empirical sealing model was developed by Bless and Satapathy at the Institute for Advanced Technology (IAT) in Austin, Tex. Their yawed rod penetration model was applied to Novel shaped penetrators. Current penetration models presented in this paper are only valid for normal rod impacts. A yawed rod model is required to fully understand the potential benefit of random tumbling Novel penetrators relative to tumbling cylindrical rods.

The full rod diameter is D while its length is L. The crater diameter is H with the penetrator yaw being δ. The critical yaw is δ which is the angle at which the aft end of the rod contacts the entrance sidewall crater. The critical yaw is computed by $$\delta_c = \sin^{-1}\left\{\frac{\frac{H}{D}-1}{2L/D}\right\} \tag{27}$$

The idea is to derive an equation that can calculate yawed rod penetration (Py) based on normal penetration PN. There currently exists mathematical models to calculate PN and if Py/PN is written, then yawed Novel penetration is normalized to PN. A non-dimensional equation can be expressed based on other non-dimensional ratios. The equation for Novel yawed penetration is $$\frac{P_y}{P_N} = X(L/D)^a(\delta/\delta_c)^b(\cos\delta)^c \tag{28}$$

Figure 55:
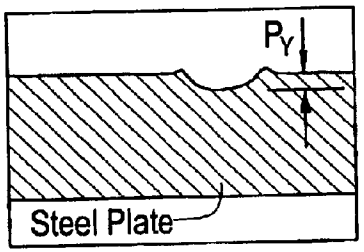
FIG. 55 is a view of the penetration of a yawed rod into a steel plate.
Figure 56:
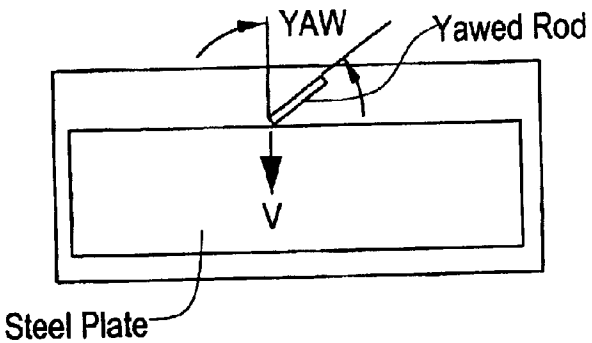
FIG. 56 is a view showing the yaw angle of rod prior penetration in a steel plate.
Figure 54:
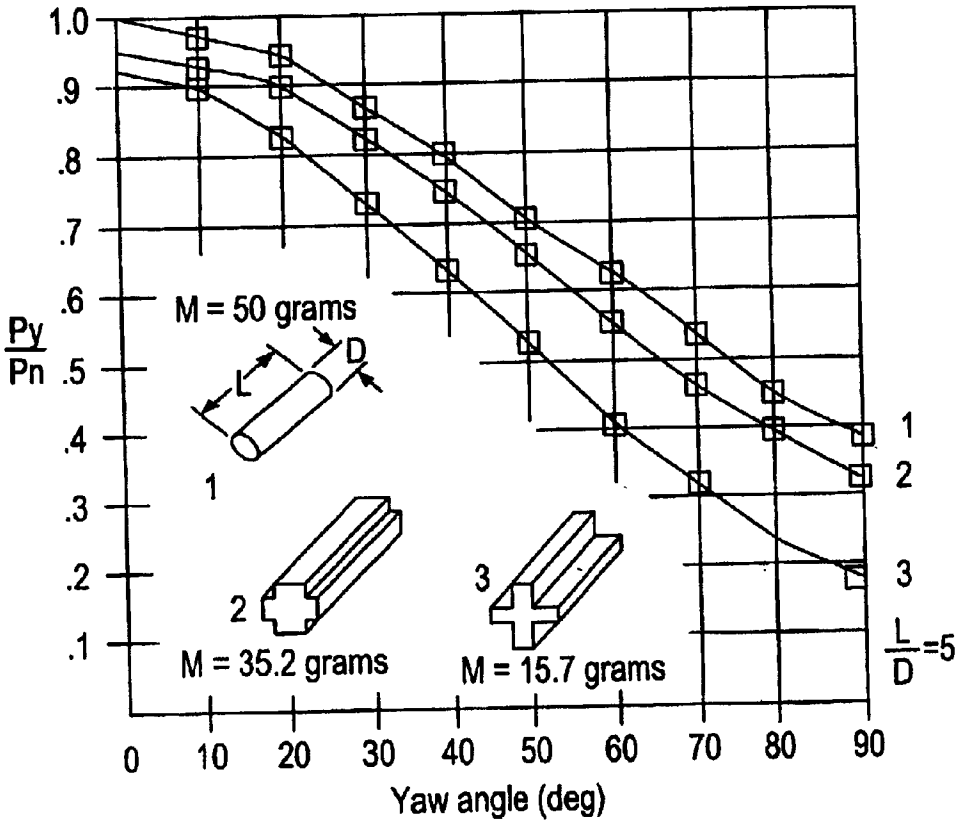
FIG. 54 is a graph showing $P_y/P_n$ versus the yaw angle for of cylindrical and cruciform shaped penetrators ($P_y$= Penetration when yawed, $P_n$=Penetration when normal)
Figure 57:
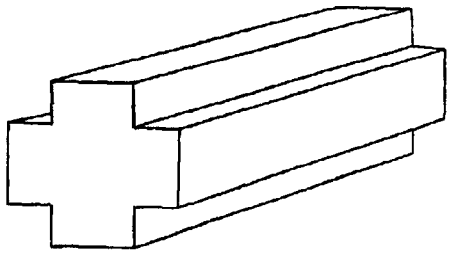
FIG. 57 is a view showing a cruciform rod that was analyzed for penetration against a chemical submunition.
Figure 58:
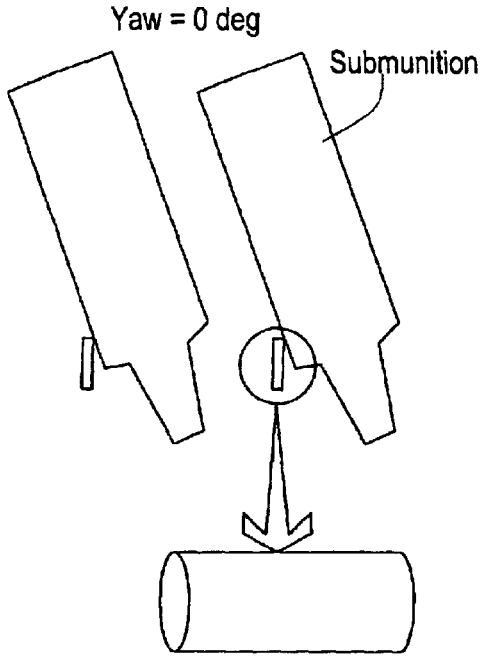
FIGS. 58–66 are schematic depictions of the yaw angle rod model used to compare the penetration efficiency of the novel penetrator compared to a baseline cylindrical rod.
Figure 59:
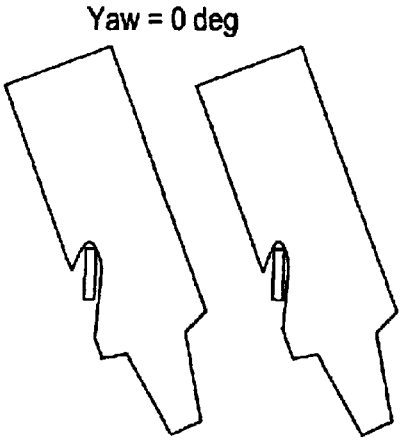
Figure 60:
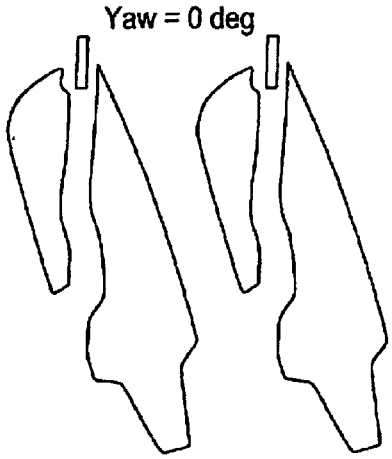
Figure 61:
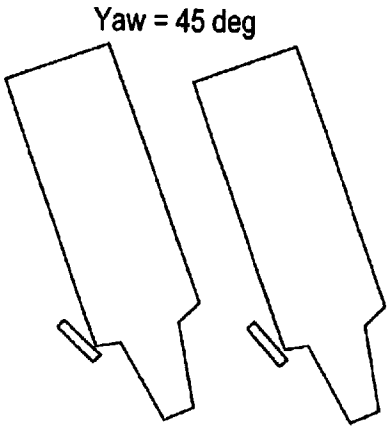
Figure 62:
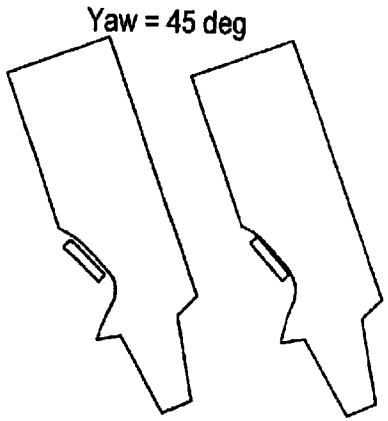
Figure 63:
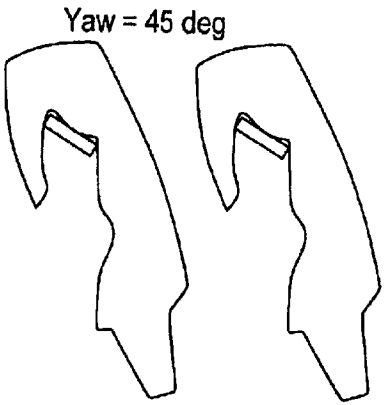
Figure 64:
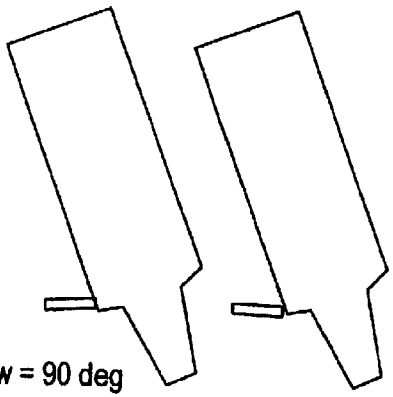
Figure 65:
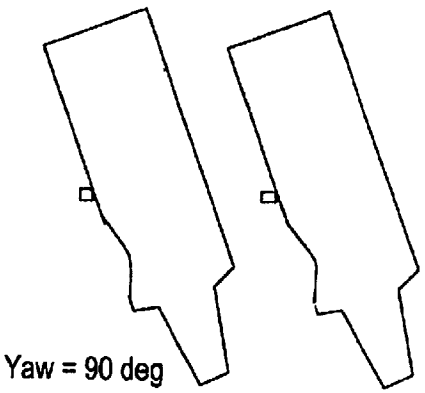
Figure 66:
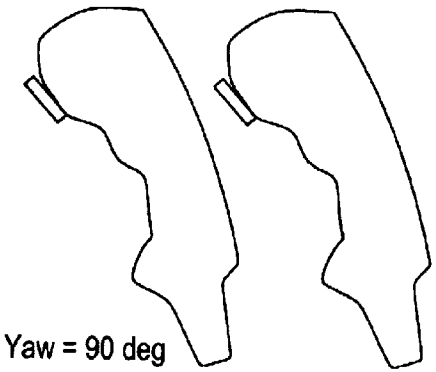
Figure 67:
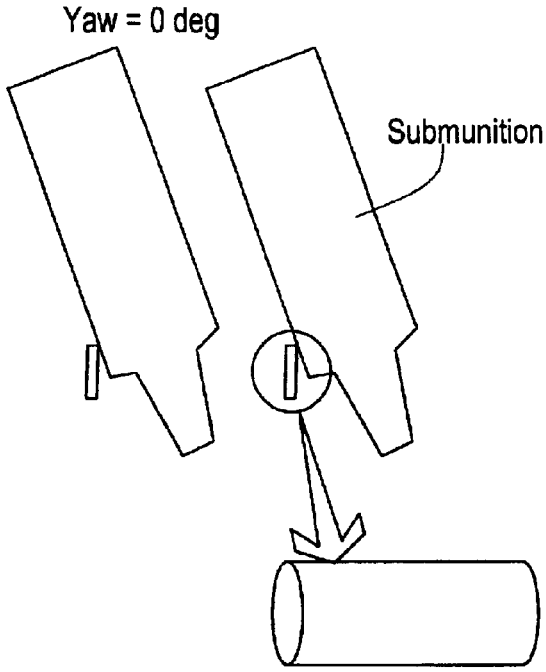
FIGS. 67–75 are views showing the penetration comparison of a 29.6 gm cruciform rod to a 40.7 gm cylindrical rod.
Figure 68:
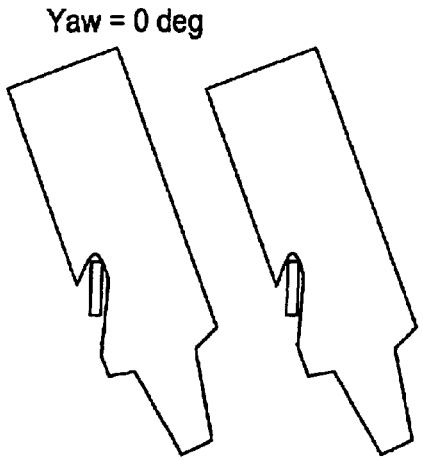
Figure 69:
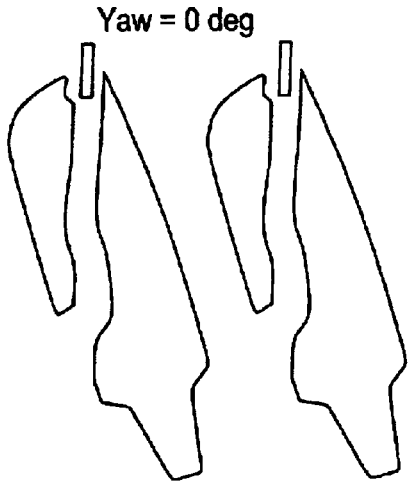
Figure 70:
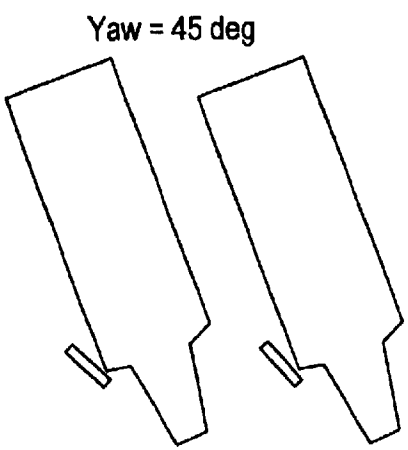
Figure 71:
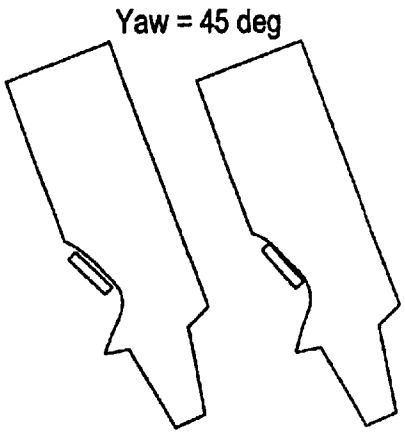
Figure 72:
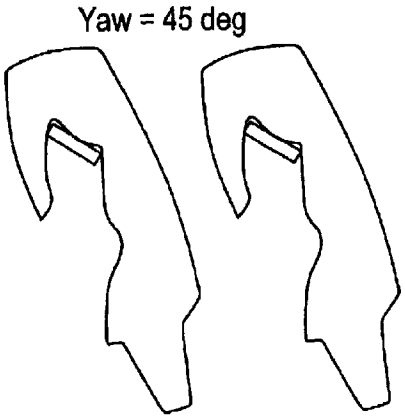
Figure 73:
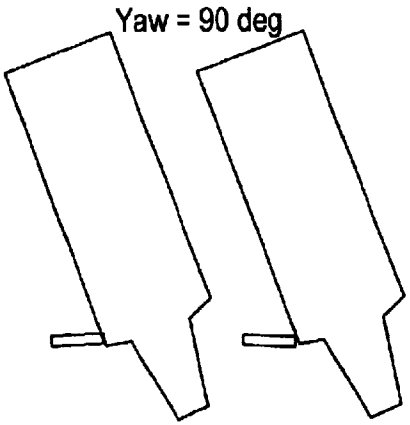
Figure 74:
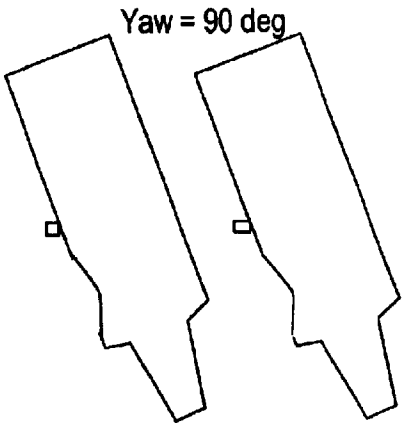
Figure 75:
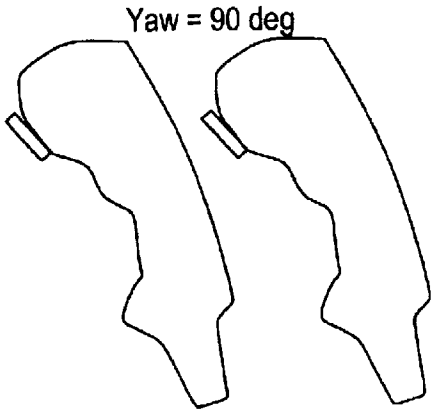

The value of δ is in radians and X is a non-dimensional constant while a, b and c are also constants. The HULL hydrocode calculated Star-Like penetration as a function of yaw and used the least square fit for a hyperplane to determine the constants. A 50 gm steel rod at 3.65 km/sec with an L/D ratio of 5 was fired into a steel plate. The cylindrical rod was made into two cruciform rods where the outer radius R is constant. All these rods contain the same length, however, the cruciform rods have reduced mass. The cruciform masses are 35.2 and 15.7 gm, respectively. A curve of Py/PN versus yaw angle is shown in FIGS. 54–56.

There is no surprise that lighter weight cruciform rods have reduced penetration compared to a full weight cylindrical rod at yaw. Thus, there exists a warhead design trade between the overall number of rods on the warhead and the overall penetration power. For example, if a warhead concept could carry 22.7 kg of penetrators, then it would contain 454 cylindrical rods. However, if a cruciform design is used then the total number of rods would change to 6444 rods weighing 35.2 gm and 1445 rods weighing 15.7 gm.

The HULL hydrocode simulation was used to investigate the penetration of cruciform rods into chemical submunitions. The penetrator on the right side is a cylindrical rod while the left penetrator is a cruciform. The cruciform rod fits into the same volume as the cylindrical rod. These penetrators are fired at 70° obliquity with a 3 km/sec impact velocity. The yaw angles varied from (normal) 0°, 45° and 90°. The cylindrical rod weighs 40.7 gm while the cruciform weighed 34.2 gm. A penetration comparison is shown in FIGS. 57–66.

The lighter cruciform rod demonstrated similar penetration compared to the full volume cylindrical rod. Another hydrocode calculation was performed where the cruciform mass was reduced down further to 29.6 gm. The same penetration comparison was performed to see if a lighter rod can obtain similar damage compared to a 40.7 gm rod. These hydrocode calculations are shown in FIGS. 67–75.

Before an optimum rod and warhead can be designed to achieve maximum lethality against a submunition payload, there must first be supporting analysis on the total number of submissions seen along a given shotline. For example, if a large or long rod is used, then there must be high probability that a second or third submunition exists after the first submunition is perforated. The probability of this occurrence must occur often or else the rod will only penetrate through the first submunition and not a second. The issue that must be investigated is the probability of seeing a second submunition along a shotline. If it is low, then it is concluded that many small rods would generate higher overall lethality.

Figure 76:
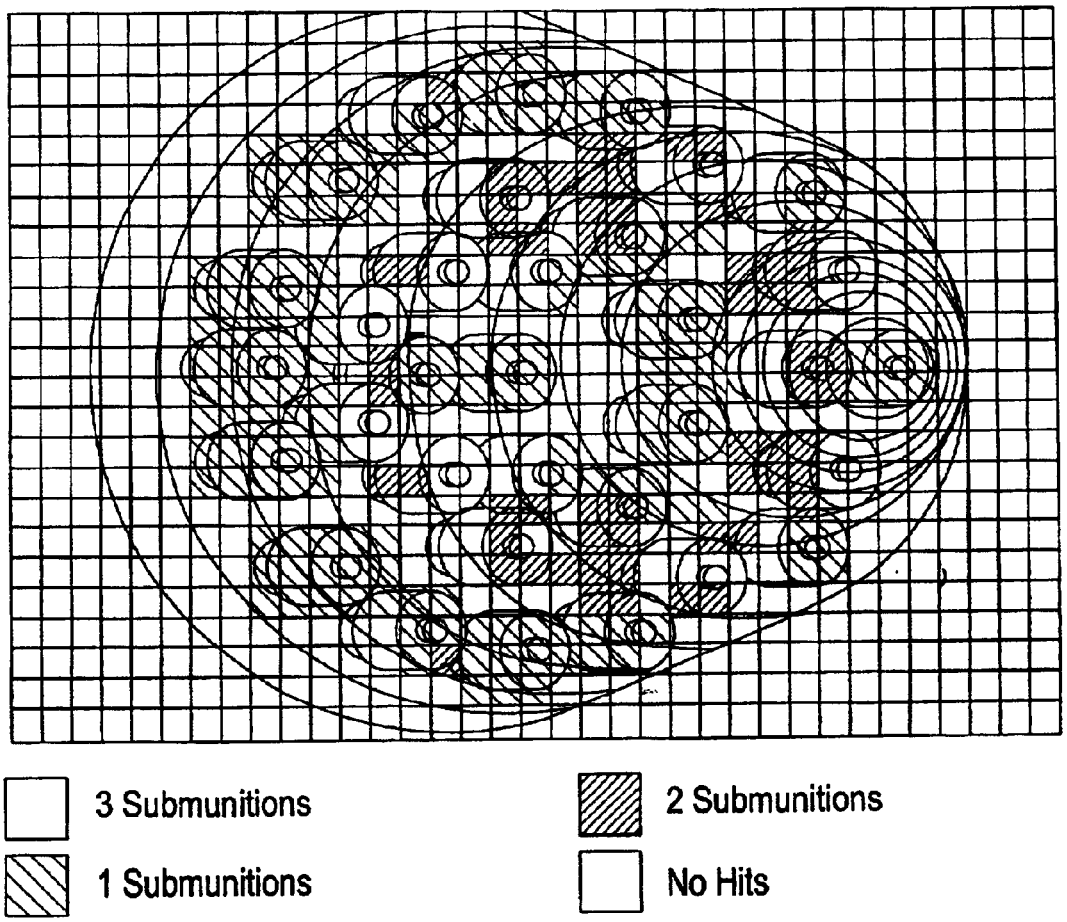
FIG. 76 is a graph showing the impact of a number of submunitions at a 10° strike angle in accordance with the subject invention.

A single 300 gm rod is weight equivalent to twelve 25 gm rods. Obviously, a 25 gm rod must be capable of penetrating a single submunition given any yaw angle if nonalignment technology is used. Another factor that must be considered is how much of the target payload can contain a large void or air pockets. This means many of the rods risk a chance of missing a submunition completely. Shotline analysis against a submunition target was performed to investigate the possibly of seeing a second or third submunition along a given shotline. A shotline grid that extends the entire length of the payload is inserted over the target. Each grid occupies a 1×1 inch area and is overlaid on the entire target. An infinitely long ray is shot through the target where the total number of submunitions intercepted are counted. An illustration of the submunition payload at a 10° strike angle is shown in FIG. 76.

The number of submunitions observed along each grid is shown for a missile intercepting a target at a 10° strike angle. The chance of killing two submunitions along a single shotline is very small.

Figures 77, 78:
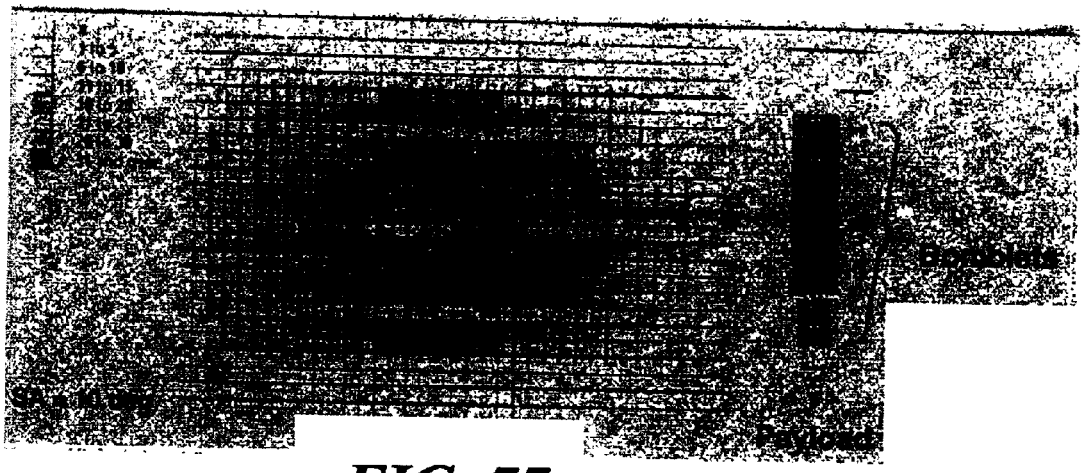
FIG. 77 is a shotline grid of a representative biological bomblet payload.
FIG. 78 is a schematic view of a typical biological bomblet payload.
Figure 79:
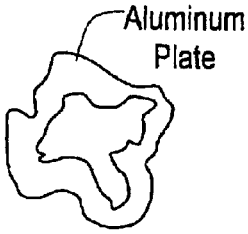
FIGS. 79–81 are schematic views of various hole profiles caused by star-shaped penetrators in accordance with the subject invention.
Figure 80:
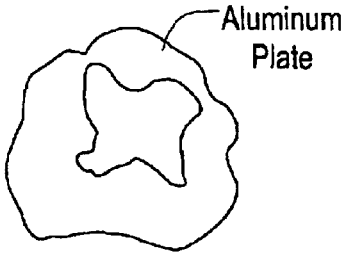
Figure 81:
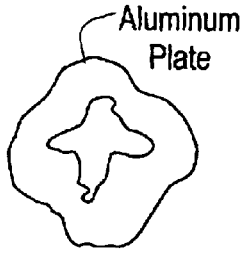
Figure 82:
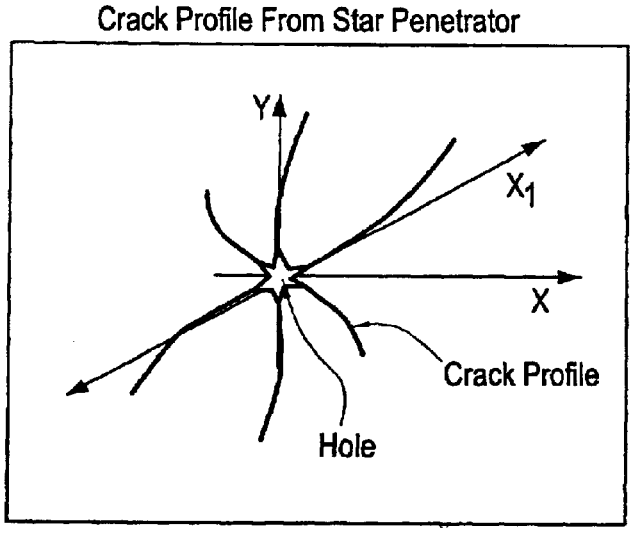
FIG. 82 is a crack profile illustration from a star-shaped penetrator in accordance with the subject invention.
Figure 83:
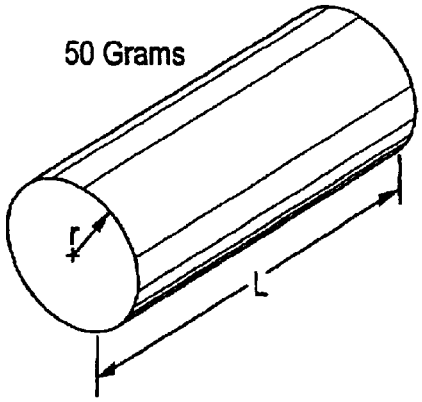
FIGS. 83–86 are schematic views showing the weight associated with various equal length penetrators.
Figure 84:
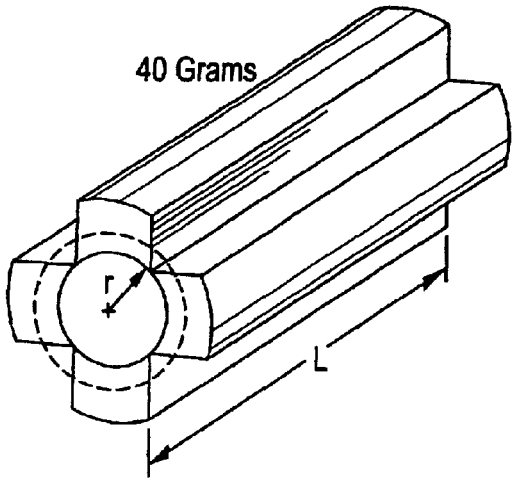
Figure 85:
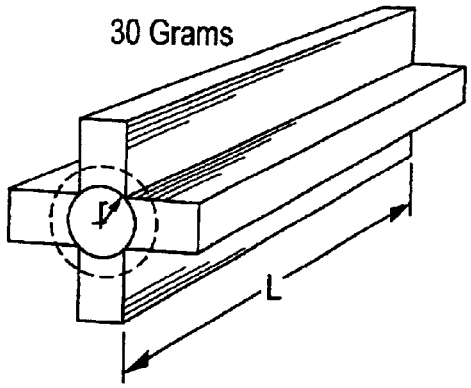
Figure 86:
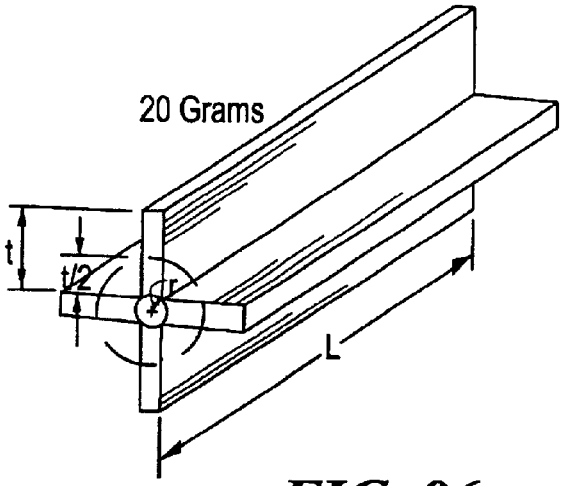

A generic biological bomblet payload was constructed to determine the total number of bomblets that could be seen on many different single shotlines. This payload contains 1460 small bomblets with no void between the bomblet layers. The thickest or most dense sections of the payload contained approximately 30 bomblets along a single shotline. The rod concept would be required to penetrate all these bomblets, as shown in FIGS. 77–78.

The use of the penetrators of this invention against bulk chemical tanks will enhance the transfer of kinetic energy to the tank causing hydraulic ram effects. This process is caused by high shock pressure with projectile drag causing subexplosive forces on the tank wall. There has been a significant amount of testing against liquid filled tanks with spherical and cubic fragments. Enhanced hydraulic ram damage occurs with cubic shaped projectiles compared to spherical projectiles. The critical velocity to obtain hydraulic ram for cubic fragments is nearly two times lower than that required for spheres. Their findings found that sharp cornered fragments generated larger cracks. Star-shaped penetrators may prove to increase hydraulic ram effects because of their ability to create many long cracks on the tank. These penetrators are designed with many sharp sides which enhance tearing of the tank wall. Steel star-shaped penetrators were fired into thin aluminum plates at high velocity. The holes clearly showed the edges of the penetrator on the damaged plate. This is shown in FIGS. 79–82.

Testing by others demonstrated that stress concentrations at the initial entrance hole are related to fracture toughness of the tank. There is a direct correlation between fracture toughness and critical impact velocity. The star-shaped penetrator contains sharp corners which increases the projectile's probability to generate sharp cracks. The impact velocity to obtain hydraulic ram is potentially lowered because of the increased crack lengths on the tank.

Lethality analysis was conducted using the RAYSCAN endgame simulation to determine if cruciform shaped rods are a better design choice then traditional cylindrical rods. The RAYSCAN model currently does not contain yawed rod penetration equations for cruciform shaped penetrators. However, an equivalent cylindrical rod was generated to obtain similar penetration given a cruciform shaped rod. These rods are made of tungsten with an L/D ratio of 10. These parameters were held consistent for the entire lethality study. The diameter of the rod varied relative to the overall mass of the cruciform rod and a description of the penetrator is shown in FIGS. 83–86.

The rod concepts weighed 50, 40, 30 and 20 gm, respectively. Since RAYSCAN does not contain yawed rod penetration equations an engineering estimate was made to determine the equivalent cylindrical rod relative to a cruciform rod. Each cruciform rod contains an inner radius r. The analysis assumed that the cruciform petal will contribute to penetration with yaw. The overall length of the peddle is represented as t. Our studies assumed half of the peddle (t/2) thickness would contribute to plate penetration. Each cruciform rod was recalibrated with its cylindrical equivalent. The rod warhead contained 454 rods weighing 50 gm each while 567 weighed 40 gm. The unused weight of the lighter rods was added to increase the total number of rods in the warhead. The total weight of rods on each warhead is 22.7 kg which corresponds to 750 and 1135 rods that weigh 30 and 20 gm, respectively.

There is an obvious trade between the individual weight and the total number of projectiles. Is it better for a warhead to contain fewer heavier rods or many lighter ones?

Endgame calculations were performed against a representative biological bomblet and chemical submunition payload. The missile missed above the TBM nose by 1.5 m and deployed all its rods in the target's direction. The fraction of bomblets/submissions killed versus overall rod yaw angle is plotted. Obviously, if rods are aligned along VR there is enhanced overall penetration.

The 22.7 lb. rod warhead performed well against the thick wall submunition payload with enhanced lethality when aligning the rods. There was a significant benefit in overall lethality against the bomblet payload as the rods became more aligned. The smaller rods penetrated more submunitions compared to heavier rods. There are 1460 bomblets in this payload and there appears to be approximately 200 more bomblets killed when utilizing the smallest rod size.

The penetrators of this invention are potential kill mechanisms that can be used in antiballistic missile warhead design concepts. These rods are packaged efficiently with less void. Russian developed penetration models are currently being used in conjunction with hydrocodes to validate normal penetration of Novel and Star-Like penetrators at hypervelocity. Our hydrocode penetration studies showed that lighter cruciform rods can penetrate submunitions to similar depths compared to full volume cylindrical rods. The RAYSCAN endgame model showed many small Novel penetrators have higher lethality compared to cylindrical type rods when volume is held constant.

In this invention, the kinetic energy rod warhead may further include, inter alia, means for aligning the individual projectiles when the explosive charge is detonated and deploys the projectiles to prevent them from tumbling and to insure the projectiles approach the target at a better penetration angle.

Figure 87:
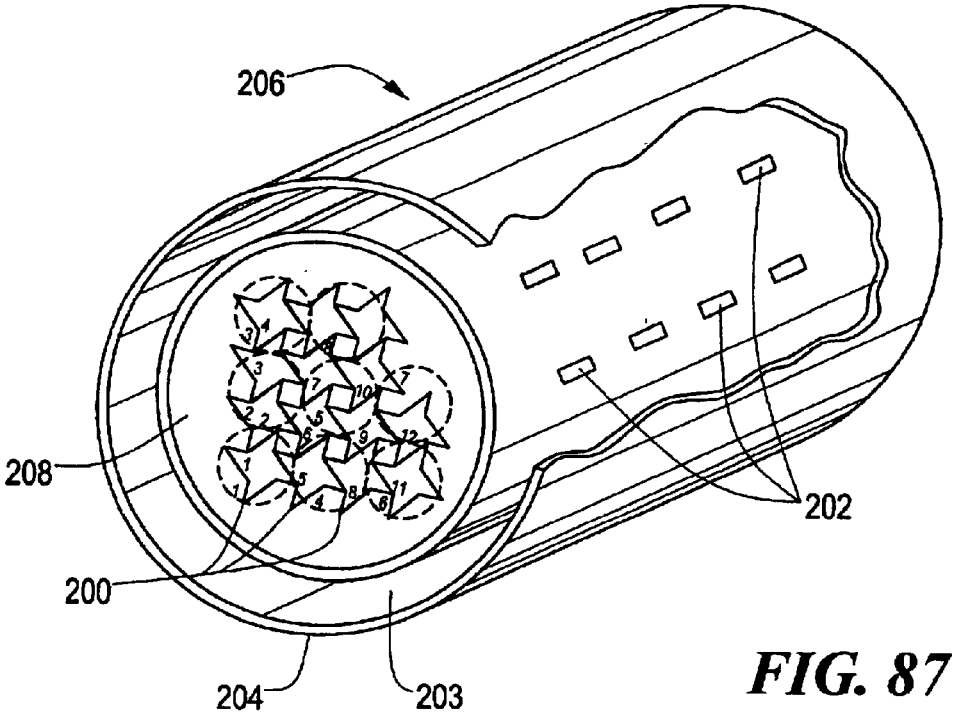
FIG. 87 is another schematic cross-sectional view showing how the use of multiple detonators aligns the penetrators of the subject invention to prevent tumbling thereof in accordance with the subject invention.

In one example, the means for aligning the individual projectiles 200, FIG. 87 include a plurality of detonators 202 (typically slapper type detonators) spaced along the length of explosive charge 203 in hull 204 of kinetic energy rod warhead 206. As shown in FIG. 87, projectile core 208 includes many individual projectiles 200 and, in this example, explosive charge 203 surrounds projectile core 208. By including detonators 202 spaced along the length of explosive charge 203, sweeping shock waves are prevented at the interface between projectile core 208 and explosive charge 203 which would otherwise cause the individual projectiles 110 to tumble.

Figure 88:
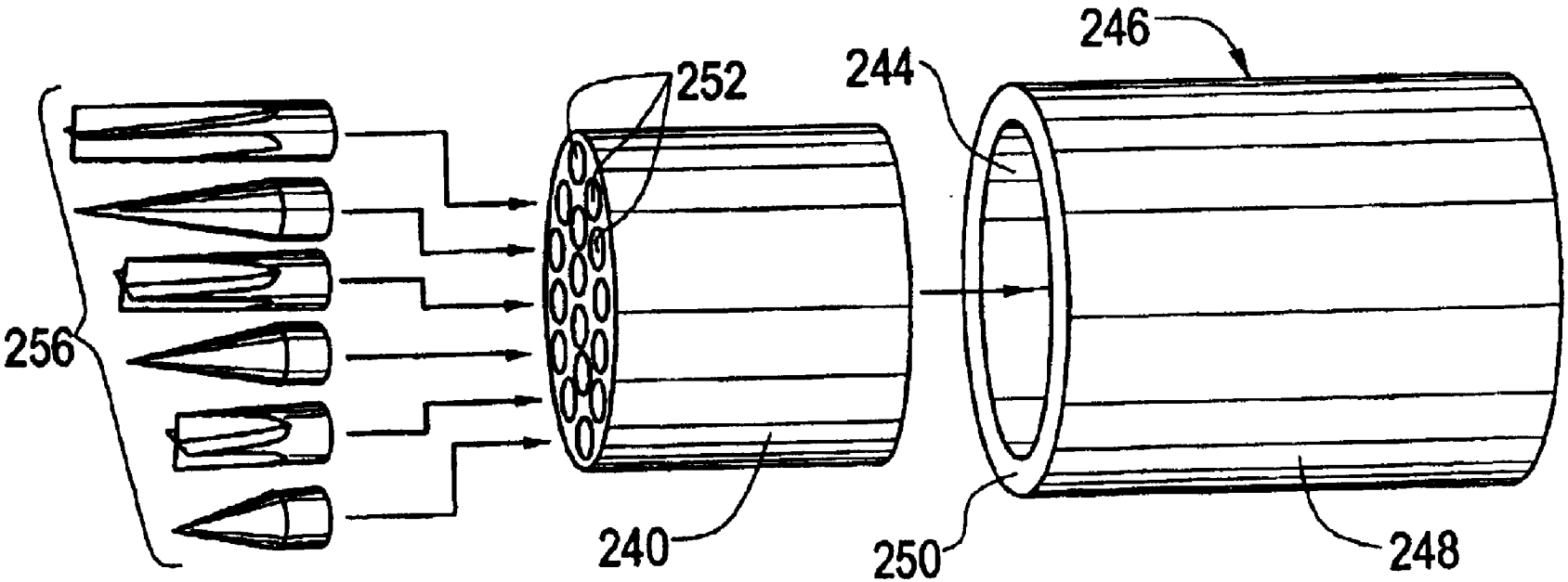
FIG. 88 is an exploded schematic three-dimensional view showing the use of a kinetic energy rod warhead core body used to align the penetrators in accordance with the subject invention.

In another example, the means for aligning the individual projectiles includes low density material (e.g., foam) body 240, FIG. 88, disposed in core 244 of kinetic energy rod warhead 246 which, again, includes hull 248 and explosive charge 250. Body 240 includes orifices 252 therein which receive projectiles 256 as shown. The foam matrix acts as a rigid support to hold all the rods together after initial deployment. The explosive accelerates the foam and rods toward the RV or other target. The foam body holds the rods stable for a short period of time keeping the rods aligned. The rods stay aligned because the foam reduces the explosive gases venting through the packaged rods.

In one embodiment, foam body 240, FIG. 88 may be combined with the multiple detonator design of FIG. 87 for improved projectile alignment.

Figure 89:
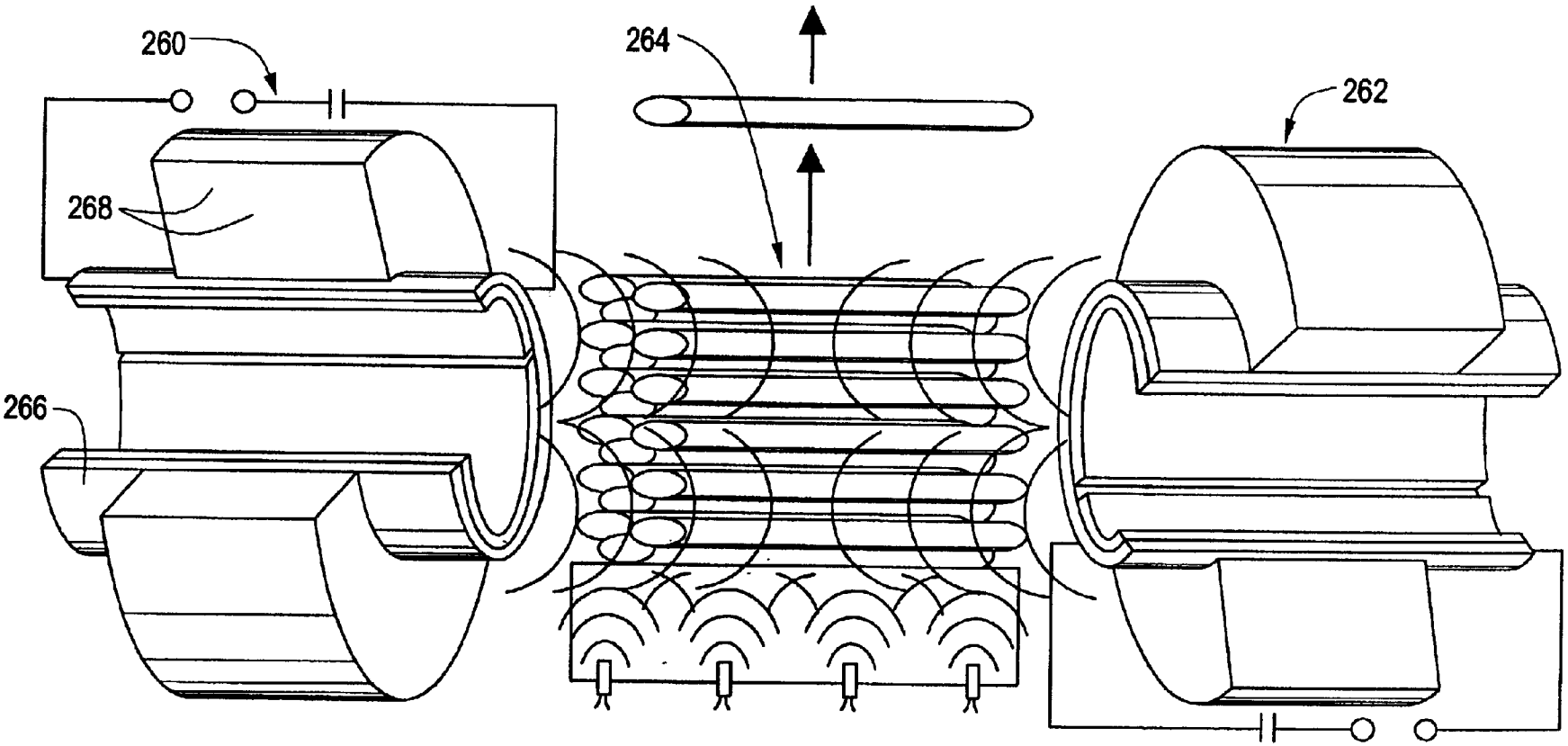
FIG. 89 is a schematic cut-away view showing the use of flux compression generators for aligning the penetrators of the kinetic energy rod warhead of the subject invention.
Figure 90:
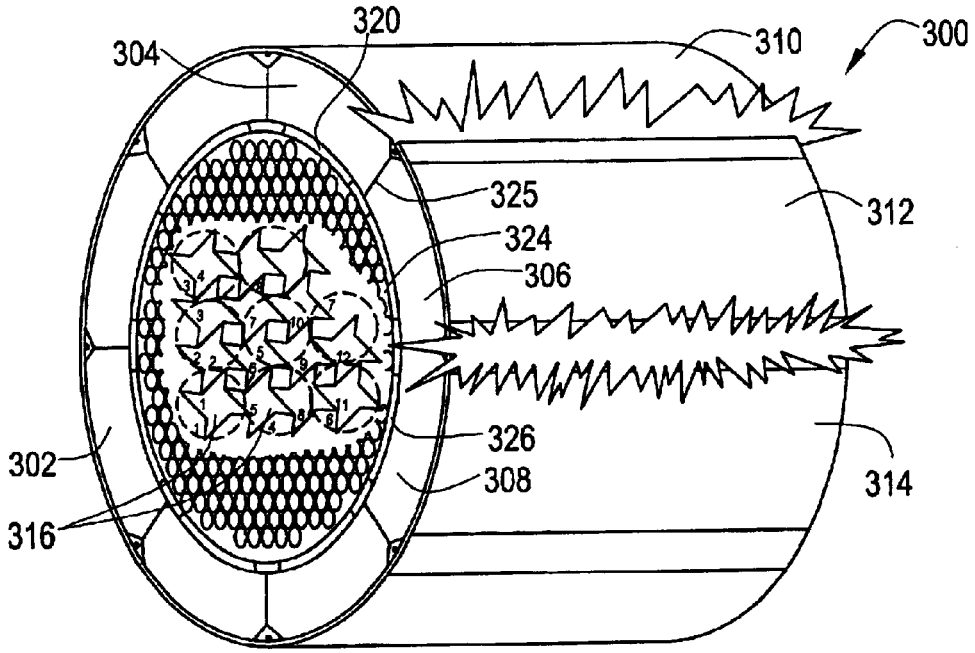

In still another example, the means for aligning the individual projectiles to prevent tumbling thereof includes flux compression generators 260 and 262, FIG. 89, one on each end of projectile core 264 each of which generate a magnetic alignment field to align the projectiles. Each flux compression generator includes magnetic core element 266 as shown for flux compression generator 260, a number of coils 268 about core element 266, and an explosive charge which implodes magnetic core element 266 when the explosive charge is detonated. The specific design of flux compression generators is known to those skilled in the art and therefore no further details need be provided here.

Figure 91:
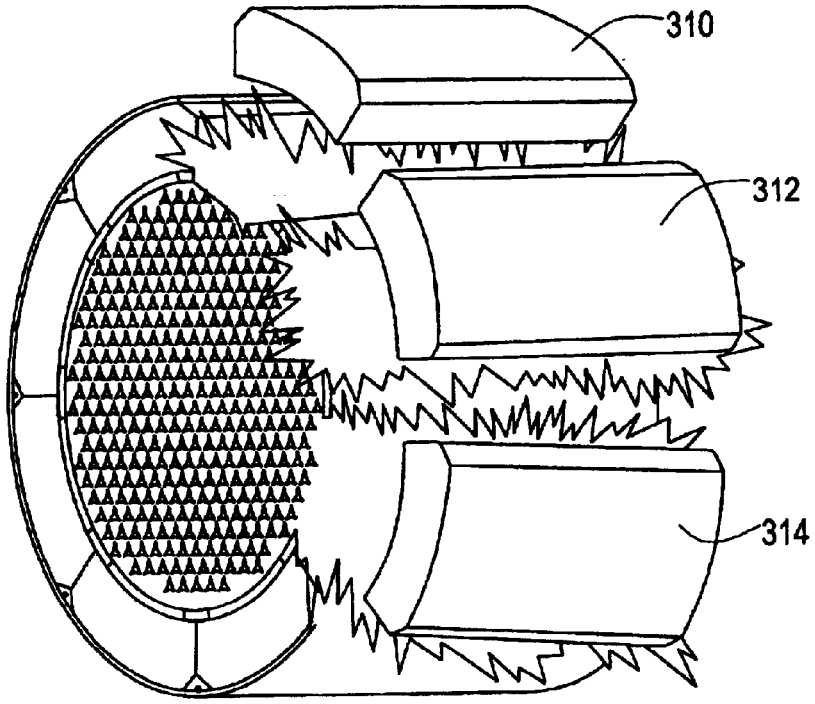

In FIGS. 90–93, kinetic energy rod warhead 300 includes an explosive charge divided into a number of sections 302, 304, 306, and 308. Shields such as shield 325 separates explosive charge sections 304 and 306. Shield 325 may be made of a composite material such as a steel core sandwiched between inner and outer lexan layers to prevent the detonation of one explosive charge section from detonating the other explosive charge sections. Detonation cord resides between hull sections 310, 312, and 314 each having a jettison explosive pack 320, 324, and 326. High density tungsten tri-star rods 316 reside in the core or bay of warhead 300 as shown. To aim all of the rods 316 in a specific direction, the detonation cord on each side of hull sections 310, 312, and 314 is initiated as are jettison explosive packs 320, 322, and 324 as shown in FIGS. 91–92 to eject hull sections 310, 312, and 314 away from the intended travel direction of projectiles 316. Explosive charge section 302, FIG. 92 is then detonated as shown in FIG. 93 using a number of detonators as discussed with reference to FIG. 87 to deploy projectiles 316 in the direction of the target as shown in FIG. 93. Thus, by selectively detonating one or more explosive charge sections, the projectiles are specifically aimed at the target in addition to being aligned using the aligning structures discussed above.

Typically, the hull portion referred to above is either the skin of a missile or a portion added to a "hit-to-kill" vehicle.

Figure 94:
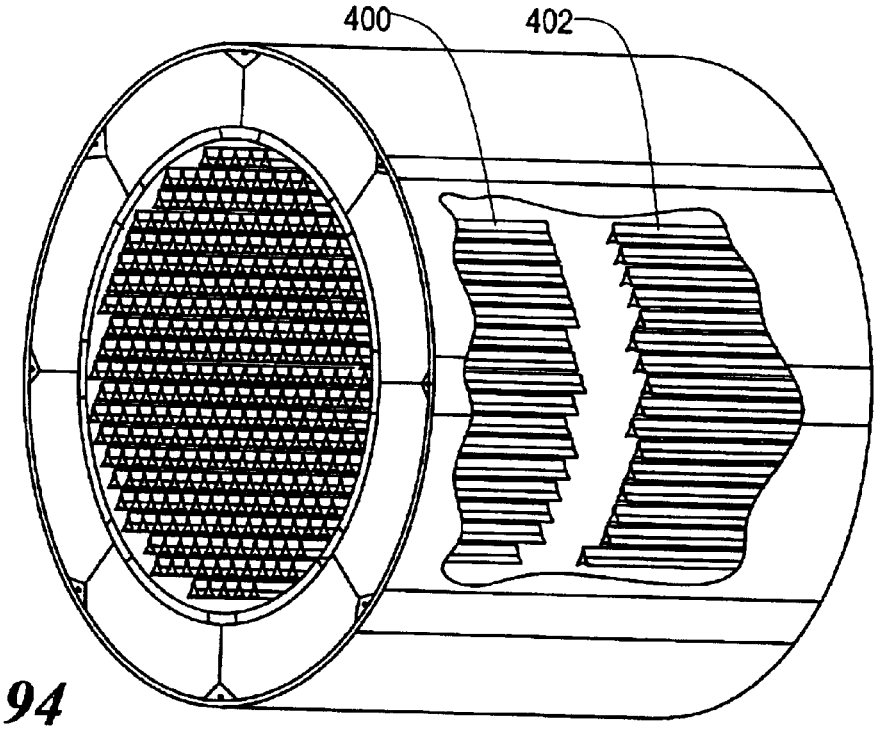
FIG. 94 is another three-dimensional partially cut-away view of another embodiment of the kinetic energy rod warhead system of the subject invention wherein there are a number of projectile bays.
Figure 95:
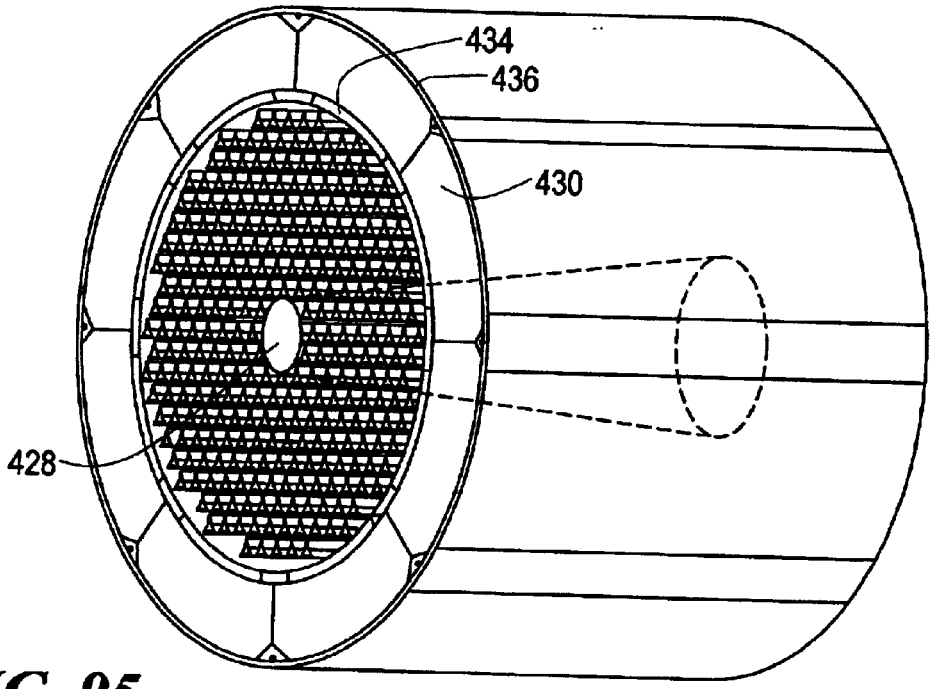
FIG. 95 is another three-dimensional schematic view showing an embodiment of the kinetic energy rod warhead system of this invention wherein the explosive core is wedge shaped to provide a uniform projectile spray pattern in accordance with the subject invention.
Figure 96:
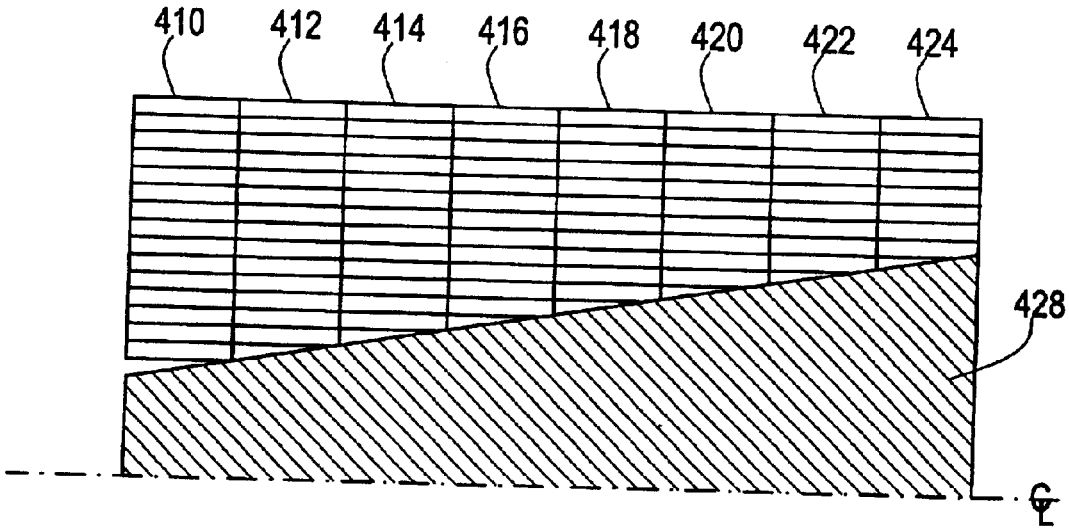
FIG. 96 is a cross sectional view showing the wedge shaped explosive core and the bays of projectiles adjacent to it for the kinetic energy rod warhead system shown in FIG. 95.

Thus far, it is assumed there is only one set of projectiles. In another example, however, the projectile core is divided into a plurality of bays 400 and 402, FIG. 94. Again, this embodiment may be combined with the embodiments discussed above. In FIGS. 95 and 96, there are eight projectile bays 410–424 and cone shaped explosive core 428 which deploys the rods of all the bays at different velocities to provide a uniform spray pattern. Also shown in FIG. 95 are wedged shaped explosive charge sections 430 with narrower proximal surface 434 abutting the projectile core and broader distal surface 436 abutting the hull of the kinetic energy rod warhead. Distal surface 436 is tapered as shown to reduce the weight of the kinetic energy rod warhead.

In any embodiment, a higher lethality kinetic energy rod warhead is provided due to the special projectile shapes and since structure associated therewith aligns the projectiles when they are deployed. In addition, the kinetic energy rod warhead of this invention is capable of selectively directing the projectiles at a target. The projectiles do not fracture, break or tumble when they are deployed. Also, the projectiles approach the target at a better penetration angle.

The kinetic energy rod warhead of this invention can be deployed as part of a missile or part of a kill vehicle. The unique projectile shapes disclosed herein have a better chance of penetrating a target and can be packed more densely. As such, the kinetic energy rod warhead of this invention has a better chance of destroying all of the bomblets and chemical submunition payloads of a target to thereby better prevent casualties.

A higher lethality kinetic energy rod warhead of this invention is also effected by the inclusion of means for aligning the individual projectiles when they are deployed to prevent the projectiles from tumbling and to provide a better penetration angle, by selectively directing the projectiles at a target, and also by incorporating special shaped projectiles.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A kinetic energy rod warhead comprising:

a hull;

a core in the hull including a plurality of individual lengthy rod penetrators; and an explosive charge in the hull about the core, the lengthy rod penetrators having a non-cylindrical cross-section for improved strength, weight, packaging efficiency, penetrability, and/or lethality.

2. The kinetic energy rod warhead of claim 1 in which the lengthy rod penetrators have opposing ends at least one of which is pointed.

3. The kinetic energy rod warhead of claim 1 in which the lengthy rod penetrators have a tri-star cross-section including three lateral spaced petals.

4. The kinetic energy rod warhead of claim 3 in which the lateral petals are spaced 120° apart.

5. The kinetic energy rod warhead of claim 1 in which the lengthy rod penetrators have a cruciform cross-section including a plurality of petals.

6. The kinetic energy rod warhead of claim 5 in which there are four petals each spaced 90° apart.

7. The kinetic energy rod warhead of claim 5 in which the petals have a constant width.

8. The kinetic energy rod warhead of claim 5 in which the petals have a opposing converging surfaces.

9. The kinetic energy rod warhead of claim 1 in which the lengthy rod penetrators have a star cross-section including a number of petals.

10. The kinetic energy rod warhead of claim 9 in which the star cross-section penetrators have opposing ends at least one of which is pointed.

11. The kinetic energy rod warhead of claim 9 in which the star cross-section penetrators have opposing ends at least one of which is wedge-shaped.

12. The kinetic energy rod warhead of claim 1 further including means for aligning the individual lengthy rod penetrators when the explosive charge deploys the lengthy rod penetrators.

13. The kinetic energy rod warhead of claim 12 in which the means for aligning includes a plurality of detonators spaced along the explosive charge configured to prevent sweeping shockwaves at the interface of the core and the explosive charge to prevent tumbling of the lengthy rod penetrators.

14. The kinetic energy rod warhead of claim 12 in which the means for aligning includes a body in the core with orifices therein, the lengthy rod penetrators disposed in the orifices of the body.

15. The kinetic energy rod warhead of claim 12 in which the means for aligning includes a flux compression generator which generates a magnetic alignment field to align the lengthy rod penetrators.

16. The kinetic energy rod warhead of claim 15 in which there are two flux compression generators, one on each end of the projectile core.

17. The kinetic energy rod warhead of claim 16 in which each flux compression generator includes a magnetic core element, a number of coils about the magnetic core element, and an explosive for imploding the magnetic core element.

18. The kinetic energy rod warhead of claim 14 in which the lengthy rod penetrators are made of a low density material.

19. The kinetic energy rod warhead of claim 1 in which the hull is the skin of a missile.

20. The kinetic energy rod warhead of claim 1 in which the hull is the portion of a "hit-to-kill" vehicle.

21. The kinetic energy rod warhead of claim 1 in which the explosive charge is outside the core.

22. The kinetic energy rod warhead of claim 1 in which the explosive charge is inside the core.

23. The kinetic energy rod warhead of claim 1 further including a buffer material between the core and the explosive charge.

24. The kinetic energy rod warhead of claim 23 in which the buffer material is a low-density material.

25. The kinetic energy rod warhead of claim 1 in which the lengthy rod penetrators are lengthy metallic members.

26. The kinetic energy rod warhead of claim 25 in which the lengthy rod penetrators are made of tungsten.

27. The kinetic energy rod warhead of claim 1 in which the explosive charge is divided into sections and there are shields between each explosive charge section extending between the hull and the core.

28. The kinetic energy rod warhead of claim 27 in which the shields are made of a composite material.

29. The kinetic energy rod warhead of claim 28 in which the composite material is steel sandwiched between lexan layers.

30. The kinetic energy rod warhead of claim 1 in which the core is divided into a plurality of bays.

31. The kinetic energy rod warhead of claim 1 in which the explosive charge is divided into a plurality of sections and there is at least one detonator per section for selectively detonating the charge sections to aim the lengthy rod penetrators in a specific direction and to control the spread pattern of the lengthy rod penetrators.

32. The kinetic energy rod warhead of claim 31 in which each explosive charge section is wedged-shaped having a proximal surface abutting the projectile core and a distal surface.

33. The kinetic energy rod warhead of claim 32 in which the distal surface is tapered to reduce weight.

34. A kinetic energy rod warhead comprising:

a hull;

a projectile core in the hull including a plurality of individual lengthy rod penetrators; and an explosive charge in the hull about the core, the lengthy rod penetrators having a non-cylindrical cross-section and opposing ends at least one of which is pointed.

35. The kinetic energy rod warhead of claim 34 in which the lengthy rod penetrators have a tri-star cross-section including three lateral spaced petals.

36. The kinetic energy rod warhead of claim 35 in which the lateral petals are spaced 120° apart.

37. The kinetic energy rod warhead of claim 35 in which the lengthy rod penetrators have a cruciform cross-section including a plurality of petals.

38. The kinetic energy rod warhead of claim 37 in which there are four petals each spaced 90° apart.

39. The kinetic energy rod warhead of claim 37 in which the petals have a constant width.

40. The kinetic energy rod warhead of claim 37 in which the petals have a opposing converging surfaces.

41. The kinetic energy rod warhead of claim 37 in which the penetrators have a star cross-section including a number of petals.

42. The kinetic energy rod warhead of claim 41 in which the star cross-section penetrators have opposing ends at least one of which is wedge-shaped.

43. The kinetic energy rod warhead of claim 34 in which the star cross-section penetrators have opposing ends at least one of which is pointed.

44. The kinetic energy rod warhead of claim 34 further including means for aligning the individual lengthy rod penetrators when the explosive charge deploys the lengthy rod penetrators.

45. The kinetic energy rod warhead of claim 44 in which the means for aligning includes a plurality of detonators spaced along the explosive charge configured to prevent sweeping shockwaves at the interface of the core and the explosive charge to prevent tumbling of the lengthy rod penetrators.

46. The kinetic energy rod warhead of claim 44 in which the means for aligning includes a body in the core with orifices therein, the lengthy rod penetrators disposed in the orifices of the body.

47. The kinetic energy rod warhead of claim 44 in which the means for aligning includes a flux compression generator which generates a magnetic alignment field to align the lengthy rod penetrators.

48. The kinetic energy rod warhead of claim 47 in which there are two flux compression generators, one on each end of the projectile core.

49. The kinetic energy rod warhead of claim 48 in which each flux compression generator includes a magnetic core element, a number of coils about the magnetic core element, and an explosive for imploding the magnetic core element.

50. The kinetic energy rod warhead of claim 34 in which the hull is the skin of a missile.

51. The kinetic energy rod warhead of claim 34 in which the hull is the portion of a "hit-to-kill" vehicle.

52. The kinetic energy rod warhead of claim 34 in which the explosive charge is outside the core.

53. The kinetic energy rod warhead of claim 34 in which the explosive charge is inside the core.

54. The kinetic energy rod warhead of claim 34 further including a buffer material between the core and the explosive charge.

55. The kinetic energy rod warhead of claim 54 in which the buffer material is a low-density material.

56. The kinetic energy rod warhead of claim 34 in which the lengthy rod penetrators are lengthy metallic members.

57. The kinetic energy rod warhead of claim 56 in which the lengthy rod penetrators are made of tungsten.

58. The kinetic energy rod warhead of claim 34 in which the explosive charge is divided into sections and there are shields between each explosive charge section extending between the hull and the projectile core.

59. The kinetic energy rod warhead of claim 58 in which the shields are made of a composite material.

60. The kinetic energy rod warhead of claim 59 in which the composite material is steel sandwiched between lexan layers.

61. The kinetic energy rod warhead of claim 34 in which the projectile core is divided into a plurality of bays.

62. The kinetic energy rod warhead of claim 34 in which the explosive charge is divided into a plurality of sections and there is at least one detonator per section for selectively detonating the charge sections to aim the lengthy rod penetrators in a specific direction and to control the spread pattern of the lengthy rod penetrators.

63. The kinetic energy rod warhead of claim 62 in which each explosive charge section is wedged-shaped having a proximal surface abutting the projectile core and a distal surface.

64. The kinetic energy rod warhead of claim 63 in which the distal surface is tapered to reduce weight.

65. A kinetic energy rod warhead comprising:

a hull;

a core in the hull including a plurality of individual lengthy rod penetrators; and an explosive charge in the hull about the core, the lengthy rod penetrators having a non-cylindrical cross section and opposing ends at least one of which is either non-cylindrical in cross section or, if cylindrical in cross section, non-flat.

66. A kinetic energy rod warhead comprising:

a hull;

a core in the hull including a plurality of individual tri-star cross section penetrators; and an explosive charge in the hull about the core.

67. A kinetic energy rod warhead comprising:

a hull;

a core in the hull including a plurality of lengthy rod penetrators having, in the case of a cylindrical cross section, a pointed or wedge-shaped end or, in the case of a non-cylindrical cross section, having a pointed or flat end;

an explosive charge in the hull about the core; and means for aligning the individual lengthy rod penetrators when the explosive charge deploys the lengthy rod penetrators.

* * * * *